US006142419A

United States Patent [19]

Arlton

[11] Patent Number: 6,142,419

[45] Date of Patent: Nov. 7, 2000

[54] LANDING GEAR ASSEMBLY FOR A MODEL HELICOPTER

[76] Inventor: Paul E. Arlton, 1132 Anthrop Dr., West Lafayette, Ind. 47906

[21] Appl. No.: 08/814,943

[22] Filed: Mar. 10, 1997

Related U.S. Application Data

[63] Continuation-in-part of application No. 08/292,718, Aug. 18, 1994, Pat. No. 5,609,312.

[51] Int. Cl.[7] ..... B64C 25/00

[52] U.S. Cl. ..... 244/100 R

[58] Field of Search ..... 244/100 R, 108, 244/129.1; D12/326, 345; 446/34, 36, 37, 230, 232

[56] References Cited

U.S. PATENT DOCUMENTS

| | | | |
|---|---|---|---|
| 2,384,516 | 9/1945 | Young . | |
| 2,641,423 | 6/1953 | Harriman et al. | 244/100 R |
| 2,689,099 | 9/1954 | Lightfoot . | |
| 3,004,736 | 10/1961 | Culver et al. . | |
| 3,027,948 | 4/1962 | Goland et al. . | |
| 3,127,696 | 4/1964 | Pagliuso . | |
| 3,144,223 | 8/1964 | Nichols | 244/100 R |
| 3,211,235 | 10/1965 | Bretl . | |
| 3,528,633 | 9/1970 | Knemeyer . | |
| 3,532,302 | 10/1970 | Dean . | |
| 3,857,533 | 12/1974 | Mason | 244/100 R |
| 4,270,711 | 6/1981 | Cresap et al. | 244/100 R |
| 4,272,041 | 6/1981 | Mabuchi et al. . | |
| 4,579,301 | 4/1986 | Brand . | |
| 4,706,907 | 11/1987 | Kopylov . | |
| 4,759,514 | 7/1988 | Burkam . | |
| 5,037,041 | 8/1991 | Unterhitzenberger . | |
| 5,211,359 | 5/1993 | Rene et al. | 244/108 |
| 5,301,900 | 4/1994 | Groen et al. . | |
| 5,358,201 | 10/1994 | Brown, Sr. | 244/108 |
| 5,381,988 | 1/1995 | Kattas . | |
| 5,609,312 | 3/1997 | Arlton et al. | 244/108 |

FOREIGN PATENT DOCUMENTS

| | | |
|---|---|---|
| 2332991 | 1/1974 | Germany . |
| 4-31197 | 2/1992 | Japan . |
| 1205263 | 9/1970 | United Kingdom . |

OTHER PUBLICATIONS

Advertising brochure for the Lite Machine™, Model 100 Helicopter (one page).

*Primary Examiner*—Peter M. Poon
*Assistant Examiner*—Charles R. Ducker, Jr.
*Attorney, Agent, or Firm*—Barnes & Thornburg

[57] ABSTRACT

A landing gear assembly is provided for use on a model helicopter. The landing gear assembly includes a landing gear strut having a leg portion and a foot portion connected to the leg portion to define an included right angle therebetween. The assembly also includes a landing gear skid formed to include a landing gear strut attachment area provided with an L-shaped slot arranged to receive and trap the foot portion of the landing gear strut therein.

48 Claims, 26 Drawing Sheets

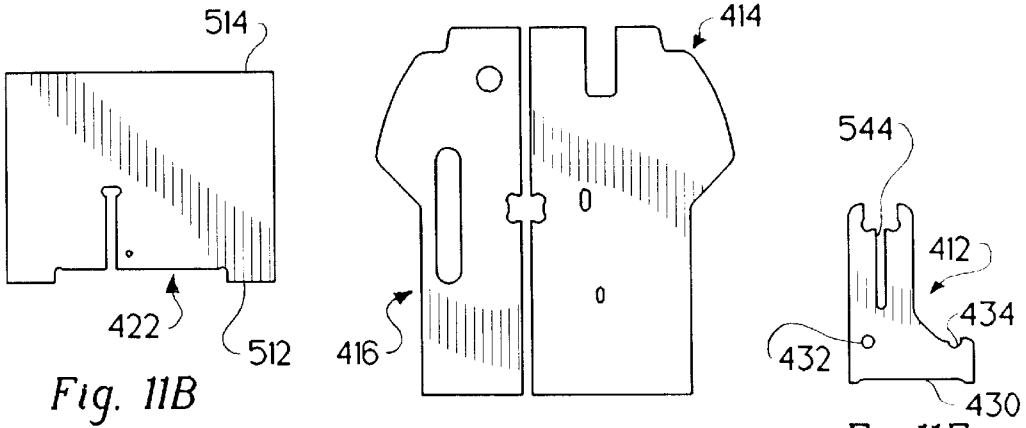
Fig.11F
Fig.11E
Fig. 11B
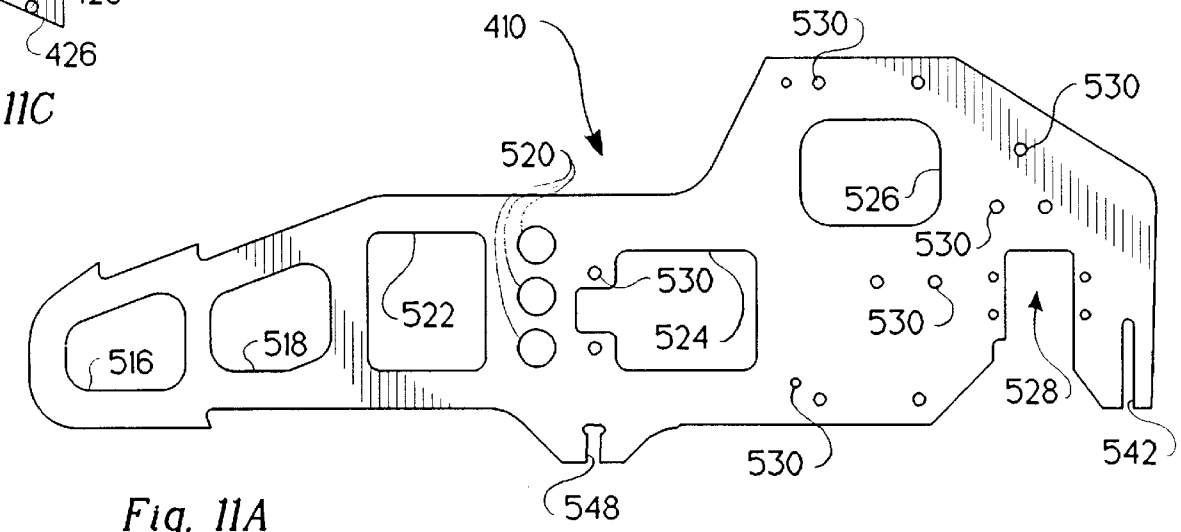
Fig. 11A
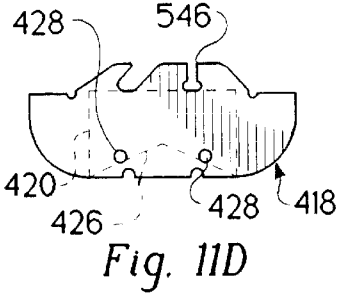
Fig. 11D
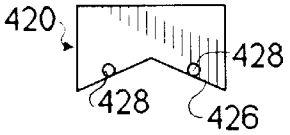
Fig. 11C

LANDING GEAR ASSEMBLY FOR A MODEL HELICOPTER

This application is a continuation-in-part application of U.S. application Ser. No. 08/292,718 filed Aug. 18, 1994 now U.S. Pat. No. 5,609,312.

BACKGROUND AND SUMMARY OF THE INVENTION

The present invention relates to the configuration and construction of landing gear elements for model aircraft. More particularly, this invention relates to simple, inexpensive landing gear elements on a model helicopter, such as a radio-controlled model helicopter, that can substantially reduce the cost and complexity and increase the strength and durability of the landing gear.

When model helicopters are at rest on the ground, they are typically supported by a plurality of landing gear struts extending downward away from a body of the model helicopter and terminating in landing gear skids situated on the ground and oriented parallel to a longitudinal axis of the helicopter. Conventional landing gear skids on radio-controlled model helicopters are made of aluminum metal tubes connected to landing gear struts made of formed aluminum sheet metal or molded plastic. Numerous brackets and bolts are generally used to connect the conventional landing gear skids to the conventional landing gear struts and the conventional landing gear struts to the body of the helicopter.

The design and material selection of both landing gear struts and landing gear skids is limited by the type of connections between the landing gear struts, landing gear skids, and body of the model helicopter. Bolt holes must be drilled or punched into metal landing gear struts or molded into plastic landing gear skids to hold the bolts that secure the connecting brackets. Malleable metal and molded plastic suitable for forming holes is generally soft and not stiff and springy as would be desirable for use as landing gear struts. As a result, landing gear made of malleable metal and molded plastic is often damaged during a hard landing of the model helicopter. The landing gear struts can be bent by the force of a crash impact and the tubular landing gear skids can kink or break at the point of attachment to the landing gear struts. Brackets that hold landing gear struts and skids together can also be bulky and unsightly and generally increase the number of parts in the landing gear assembly.

For decades, fixed-wing model airplanes have been equipped with resilient landing gear assemblies formed of spring steel music wire. Spring steel wire can be easily and economically formed by bending and can be flexed repeatedly in operation and still return to a desired shape. Spring steel wire has not been used effectively for landing gear on commercially available model helicopters, however, because no commercially suitable means has existed to connect wire struts to landing gear skids.

Conventional landing gear skids themselves can be improved to resist hard landings without damage. Existing landing gear skids are generally manufactured of stiff, relatively heavy materials such as aluminum or steel formed into hollow tubes to reduce weight. These landing gear skids are often permanently deformed during hard landings. Landing gear skids made of a flexible plastic material are more durable, lower in weight, and more economical to manufacture than are metal landing gear skids. Plastic landing gear skids have not been offered commercially primarily because of the wide market acceptance of metal landing gear skids and the unrecognized value of plastics over metals in this application.

What is needed is a simple and sturdy landing gear assembly that is easy to manufacture and assemble, and is also durable in a crash of a model aircraft. Such a landing gear assembly would be welcomed by model helicopter enthusiasts.

According to the present invention, a landing gear assembly is provided for use on a model helicopter having a body. The landing gear assembly includes a landing gear strut and a landing gear skid. The landing gear strut includes a leg portion and a foot portion connected to the leg portion to define an included angle between the foot portion and the leg portion. The landing gear skid is formed to include a landing gear strut attachment area and the foot portion of the landing gear strut engages the landing gear strut attachment area.

In preferred embodiments of the present invention, the landing gear strut attachment area includes a loading segment, a trapping segment, and an upright-connecting segment or boot. The loading segment is configured to receive the foot portion of the landing gear strut, the trapping segment is configured to receive the foot portion from the loading segment and retain the foot portion within the landing gear skid, and the boot is configured to receive and retain a lower section of the leg portion of the landing gear strut.

The loading segment is defined by a loading channel formed in the landing gear skid and the trapping segment is defined by a trapping channel formed in the landing gear skid. The boot includes a collar and a boot channel extending through the collar. The loading channel and trapping channel extend along a first axis and the boot channel extends along a second axis that is substantially perpendicular to the first axis to define a T-shaped slot in the landing gear skid.

The landing gear strut is connected to the landing gear skid as follows. First, the foot portion of the landing gear strut is inserted into the loading channel. Second, the foot portion is slid from the loading channel into the trapping channel. Third, the landing gear skid is rotated about the foot portion to place the lower section of the leg portion within the boot.

In a preferred embodiment of the present invention, the lower section of the leg portion is connected to the landing gear skid by a snap-fit connection formed in the boot. When the landing gear skid is rotated about the foot portion to place the lower section of the leg portion within the boot, the lower section of the leg portion is snapped into the boot.

In another preferred embodiment of the present invention, the landing gear strut attachment area includes a loading/trapping segment and an upright-connecting segment or boot. The loading/trapping segment is defined by a loading/trapping channel formed in the landing gear skid and the boot includes a collar and a boot channel extending through the collar and communicating with the loading/trapping channel to form a L-shaped slot. The landing gear strut is connected to the landing gear skid by snapping the foot portion of the landing gear strut into the loading/trapping channel and snapping the lower section of the leg portion into the boot channel.

In other preferred embodiments, the landing gear skid may be made from a material that is not suitable for snap-fit connections. In these embodiments, a separate locking element is engaged with at least one of the landing gear skid and landing gear strut to secure the landing gear skid to the landing gear strut.

The landing gear assembly generally comprises a wire landing gear strut having an angled end portion and a landing gear skid having an integral connection area receptive to the angled end portion of the landing gear strut to hold the landing gear skid and landing gear strut together. Such a configuration tends to transmit crash forces more uniformly between the landing gear strut and landing gear skid.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 5 is a perspective exploded view of the landing gear struts and the landing gear skids;

FIG. 5C is a perspective exploded view of the landing gear skid being rotated 90° so that the L-shaped portion snaps into the boot channel formed in the boot of the landing gear skid to secure the landing gear skid to the landing gear strut;

FIG. 11A is a side elevation view of an elongated, flat keel of the fuselage showing various slots and apertures formed in the keel for holding various helicopter radio, control, and drive train components;

FIGS. 11B—11F are views of various pieces of the fuselage that mount onto the keel to support the canopy and the landing gear in the manner shown in FIGS. 2 and 16–18;

FIG. 11B is a plan view of a floor that attaches to a bottom side of the keel;

FIG. 11C is a side elevation view of a bulkhead reinforcement;

FIG. 11D is a side elevation view of a landing gear bulkhead that attaches to the bottom side of the keel and showing (in phantom) where the bulkhead reinforcement shown in FIG. 11C is appended to the landing gear bulkhead;

FIG. 11E is a side elevation view of first and second bulkhead fire walls that are mounted to opposite sides of the elongated, flat keel and are positioned to lie at the rear edge of the canopy and adjacent to the model helicopter engine;

FIG. 11F is a side elevation view of a landing gear bracket that attaches to the bottom side of the elongated, flat keel;

DETAILED DESCRIPTION OF THE DRAWINGS

A model helicopter 10 in accordance with the present invention includes an improved landing gear assembly. The landing gear assembly includes front and rear landing gear struts and two spaced-apart landing gear skids that connect to each other through a snap-fit connection. The snap-fit connection between the landing gear struts and landing gear skids permits the struts and skids to connect together without the use of an adhesive or separate fastener. Further, the landing gear skids are each formed to include a landing gear strut-receiving area into which a portion of a landing gear strut extends to provide a sturdy and durable connection between the landing gear skids and landing gear struts.

Figure 1:
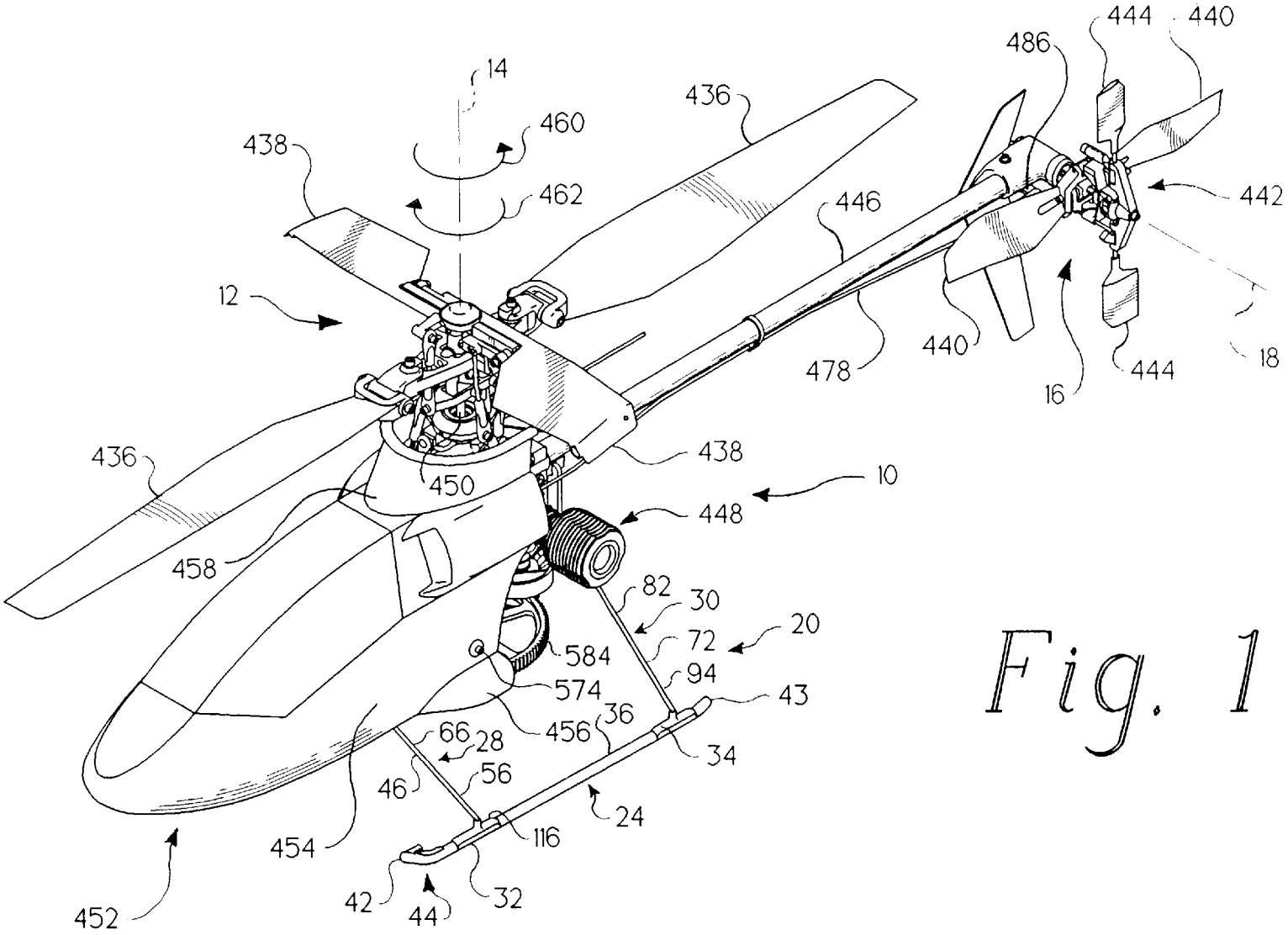
FIG. 1 is a perspective view of a model helicopter in accordance with the present invention showing a main rotor, tail rotor, canopy, and landing gear assembly.
Figure 2:
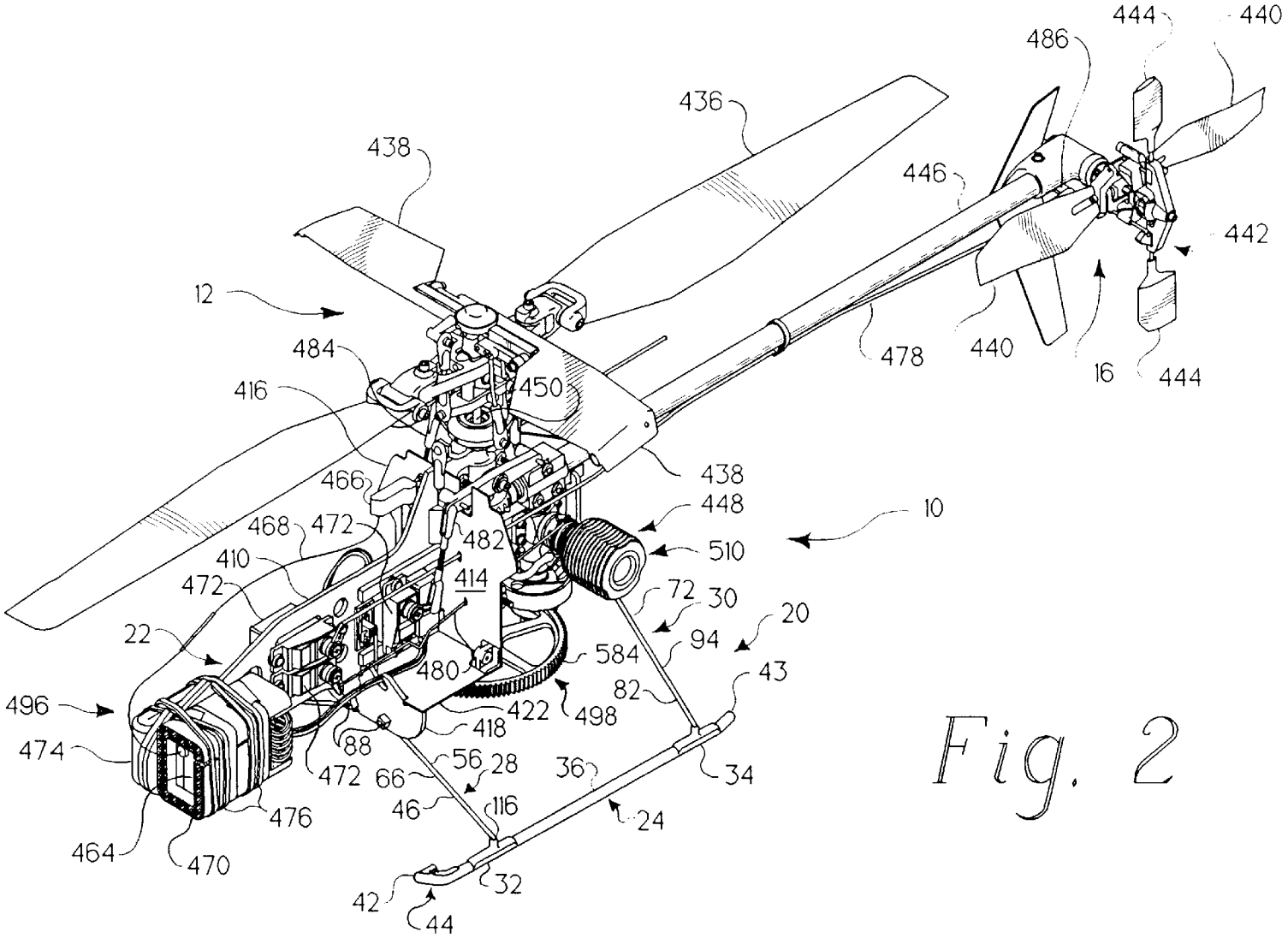
FIG. 2 is a perspective view of the model helicopter shown in FIG. 1, with the canopy removed, to show the model helicopter further including a fuselage and radio-control and servo-control elements coupled to the fuselage.

Model helicopter 10 is shown, for example, in FIGS. 1 and 2. Helicopter 10 includes a large main rotor 12 which rotates about a main rotor axis 14 to lift helicopter 10 into the air, a smaller tail rotor 16 which rotates about a tail rotor axis 18 to counteract torque produced by main rotor 12 and steer helicopter 10, a landing gear assembly 20, and a fuselage 22 which supports main rotor 12, tail rotor 16, and landing gear assembly 20. Landing gear assembly 20 supports helicopter 10 when helicopter 10 is sitting on the ground.

Figure 3:
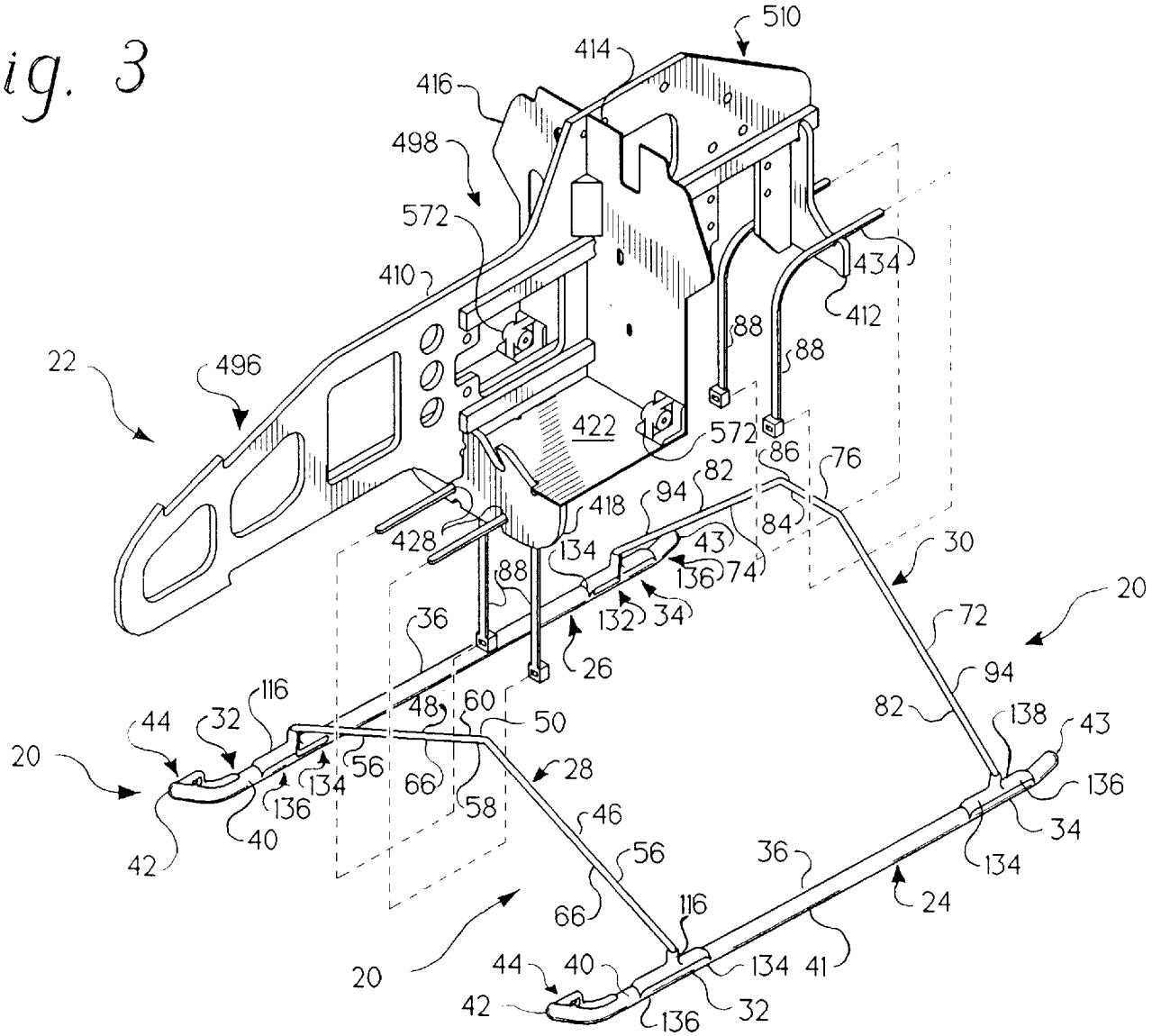
FIG. 3 is an exploded perspective view of the fuselage and landing gear assembly showing the landing gear assembly including front and rear landing gear struts to be connected to the fuselage using a cable tie and spaced-apart landing gear skids connected to the front and rear landing gear struts.

Landing gear assembly 20 includes a pair of landing gear skids 24, 26 and front and rear landing gear struts 28, 30 connected to each of landing gear skids 24, 26 as shown in FIG. 3. Landing gear struts 28, 30 connect to fuselage 22 and extend downwardly toward landing gear skids 24, 26.

Figures 4, 4A, 4B, 4C, 4D:
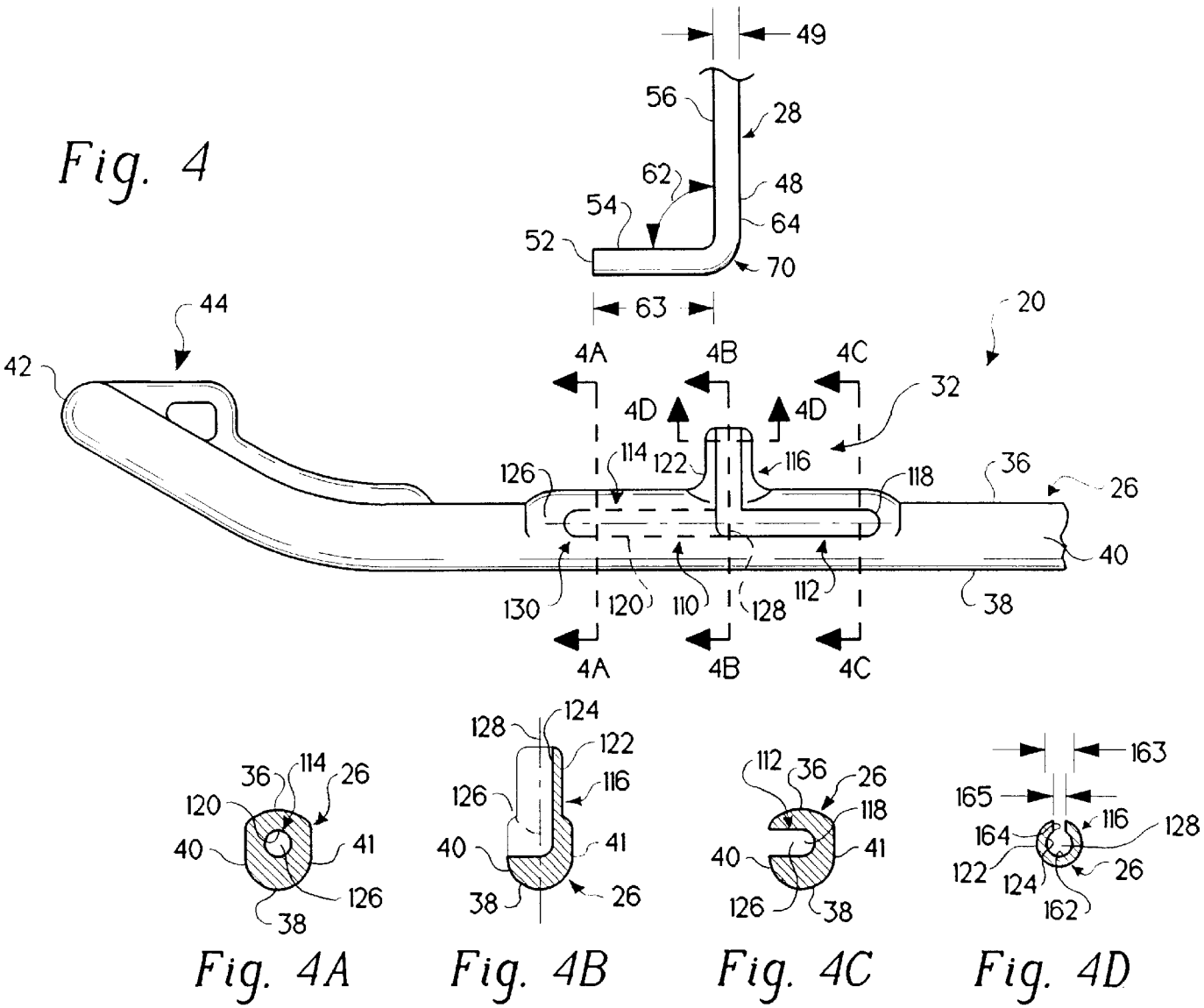
FIG. 4 is an enlarged side elevation view of a landing gear skid being formed to include a landing gear strut attachment area defined by an inverted T-shaped slot formed in the landing gear skid and an L-shaped portion of a landing gear strut that extends into the inverted T-shaped slot formed in the landing gear skid.
FIG. 4A is a sectional view taken along lines 4A—4A of FIG. 4 showing the landing gear strut attachment area including a trapping channel formed in the landing gear skid.
FIG. 4B is a sectional view taken along lines 4B—4B of FIG. 4 showing the landing gear strut attachment area including a boot extending upwardly toward the body of the helicopter and the boot including a collar and a boot channel extending through the collar.
FIG. 4C is a sectional view taken along lines 4C—4C of FIG. 4 showing the landing gear strut attachment area including a loading channel formed in the landing gear skid.
FIG. 4D is a sectional view taken along lines 4D—4D of FIG. 4 showing the boot channel including a snap-fit channel and a wider retaining channel.
Figure 5:
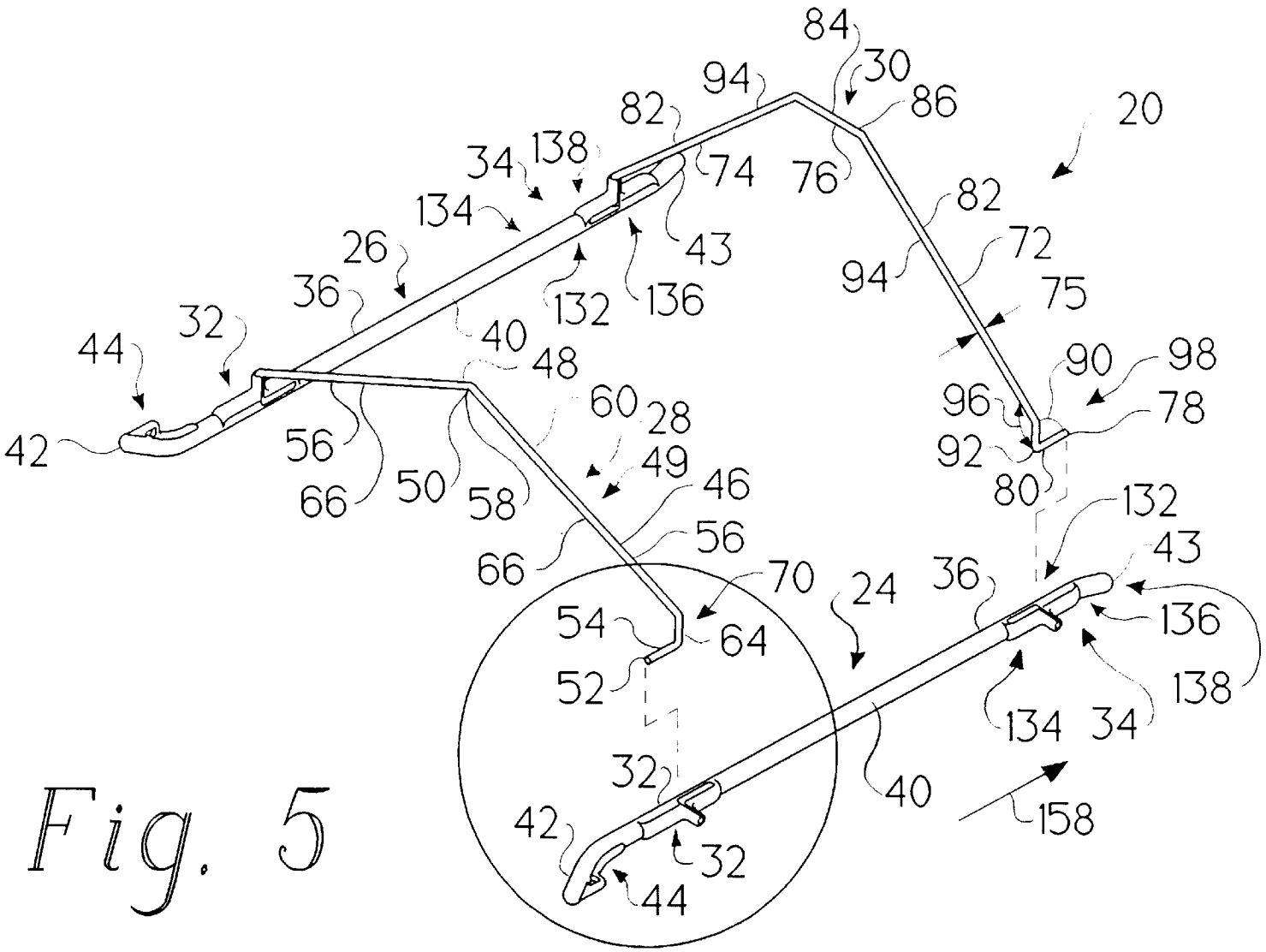
FIGS. 5–5C illustrate a preferred assembly sequence for connecting the landing gear struts and landing gear skids.

As shown, for example, in FIGS. 4 and 5, each of landing gear skids 24, 26 is formed to include two spaced-apart landing gear strut attachment areas 32, 34 to receive a portion of landing gear struts 28, 30, a top surface 36 facing upwardly toward fuselage 22, a bottom surface 38 facing downwardly away from fuselage 22, first and second side surfaces 40, 41 positioned to lie between top and bottom surfaces 36, 38, a front end 42, and a back end 43. Each of landing gear skids 24, 26 further includes a tie down 44 which is an aesthetic feature to provide model helicopter 10 with the appearance of a full-size helicopter.

Front landing gear strut 28 includes a first side 46 connected to landing gear skid 24 a second side 48 connected to landing gear skid 26, and a diameter 49 as shown, for example, in FIGS. 4 and 5. Each of the first and second sides 46, 48 includes a proximal end 50, a distal end 52 spaced apart from proximal end 50 and defining a foot portion 54, and a leg portion 56 extending between the proximal end 50 and distal end 52. Front landing gear strut 28 is an inverted V-shape and proximal end 50 of first side 46 is connected to proximal end 50 of second side 48 to define a vertex 58 of V-shaped front landing gear strut 52. Proximal ends 50 of first and second sides 46, 48 define a fuselage-connecting portion 60 of front landing gear strut 28.

Foot portion 54 extends substantially perpendicular from leg portion 56 toward front end 42 of landing gear skid 24, 26 a length 63 to define an included angle 62 of approximately 90° as shown, for example, in FIGS. 4 and 5. Leg portion 56 includes a lower section 64 positioned to lie adjacent to foot portion 54 and an upper section 66 spaced apart from lower section 64 and positioned to lie adjacent to fuselage-connecting portion 60 as shown in FIG. 5. The lower section 64 of the leg portion 56 is connected to upper section 66 of leg portion 56 to define an included angle 68 of approximately 115°. The lower section 64 of leg portion 56 and foot portion 54 form a L-shaped portion 70 that extends into landing gear strut attachment areas 32 formed in landing gear skids 24, 26.

Rear landing gear strut 30 includes a first side 72 connected to landing gear skid 24, a second side 74 connected to landing gear skid 26, and a diameter 75 that is equal to diameter 49 as shown in FIGS. 4 and 5. Each of first and second sides 72, 74 includes a proximal end 76, a distal end 78 spaced apart from proximal end 76 and defining a foot portion 80, and a leg portion 82 extending between proximal end 76 and distal end 78. Rear landing gear strut 30 is an inverted U-shaped relative to front landing gear strut 28. Proximal end 76 of first side 72 is connected to proximal end 76 of second side 74 to define a flat bottom section 84 of U-shaped rear landing gear strut 30. Proximal ends 76 of first and second sides 72, 74 define a fuselage-connecting portion 86 of rear landing gear strut 30. Fuselage-connecting portions 60, 86 of front and rear landing gear struts 28, 30 are connected to fuselage 22 with cable ties 88 as shown, for example, in FIG. 3.

Foot portion 80 extends substantially perpendicular from leg portion 82 toward rear end 43 of landing gear skid 24, 26 a length equal to length 63 to define an included angle 90 of approximately 90° as shown in FIG. 5. The leg portion 82 includes a lower section 92 positioned to lie adjacent to the foot portion 80 and an upper section 94 spaced apart from lower section 92 and positioned to lie adjacent to fuselage-connecting portion 86. The lower section 92 of leg portion 82 is connected to upper section 94 of leg portion 82 to define an included angle 96 of approximately 130°. The lower section 92 of leg portion 82 and foot portion 80 form a L-shaped portion 98 that extends into landing gear strut attachment areas 34 formed in landing gear skids 24, 26.

Landing gear strut attachment area 32 of landing gear skids 24, 26 is defined by an inverted T-shaped slot 110 formed in landing gear skids 24, 26 as shown, for example, in FIG. 4. Each inverted T-shaped slot 110 is defined by a loading segment 112 configured to receive foot portion 54 of front landing gear strut 28, a trapping segment 114 configured to receive and retain foot portion 54 within landing gear skid 24, 26, and an upright-connecting segment or boot 116 positioned to lie between loading segment 112 and trapping segment 114 and configured to receive and retain lower section 64 of leg portion 56 of front landing gear strut 28.

The loading segment 112 is defined by a loading channel or slot 118 formed in side surface 40 of landing gear skid 24, 26 as shown, for example, in FIGS. 4 and 4C. The trapping segment 114 is defined by a hollow area or trapping channel 120 formed in landing gear skid 24, 26 as shown, for example, in FIGS. 4 and 4A. The boot 116 includes a collar 122 appended to top surface 36 of landing gear skid 24, 26 and arranged to extend upwardly toward fuselage 22. Boot 116 is further formed to include a boot slot or channel 124 extending though collar 122 as shown, for example, in FIGS. 4, 4B, and 4D.

Loading channel 118 and trapping channel 120 extend along a common axis 126 and boot channel 124 extends along an axis 128 that is substantially perpendicular to axis 126 as shown in FIGS. 4–4C. Loading channel 118 extends between boot channel 124 and rear end 43 of landing gear skids 24, 26 and trapping channel 120 extends between boot channel 124 and front end 42 of landing gear skids 24, 26. The loading channel 118, trapping channel 120, and boot channel 124 all communicate with each other. The trapping channel 120 and boot channel 124 comprise a L-shaped channel 130 formed in landing gear skids 24, 26 to receive L-shaped portion 70 of front landing gear strut 28.

Landing gear strut attachment area 34 is defined by an inverted T-shaped slot 132 formed in landing gear skids 24, 26 as shown in FIG. 5. Each inverted T-shaped slot 132 is defined by a loading segment 134 configured to receive foot portion 80 of rear landing gear strut 30, a trapping segment 136 configured to receive and retain foot portion 80 within landing gear skid 24, 26, and an upright-connecting segment or boot 138 positioned to lie between loading segment 134 and trapping segment 136 and configured to receive and retain lower section 92 of leg portion 82 of rear landing gear strut 30.

Landing gear strut attachment area 34 is identical to landing gear strut attachment area 32 except that loading segment 134 of landing gear strut attachment area 34 is situated between boot 138 and front end 42 of landing gear skid 24, 26 and loading segment 112 of landing gear strut attachment area 32 is situated between boot 116 and rear end 43 of landing gear skid 24, 26. Similarly, trapping segment 136 of landing gear strut attachment area 34 is situated between boot 138 and rear end 43 of landing gear skid 24, 26 and trapping segment 114 of landing gear strut attachment area 32 is situated between boot 116 and front end 42 of landing gear skid 24, 26.

Figure 5A:
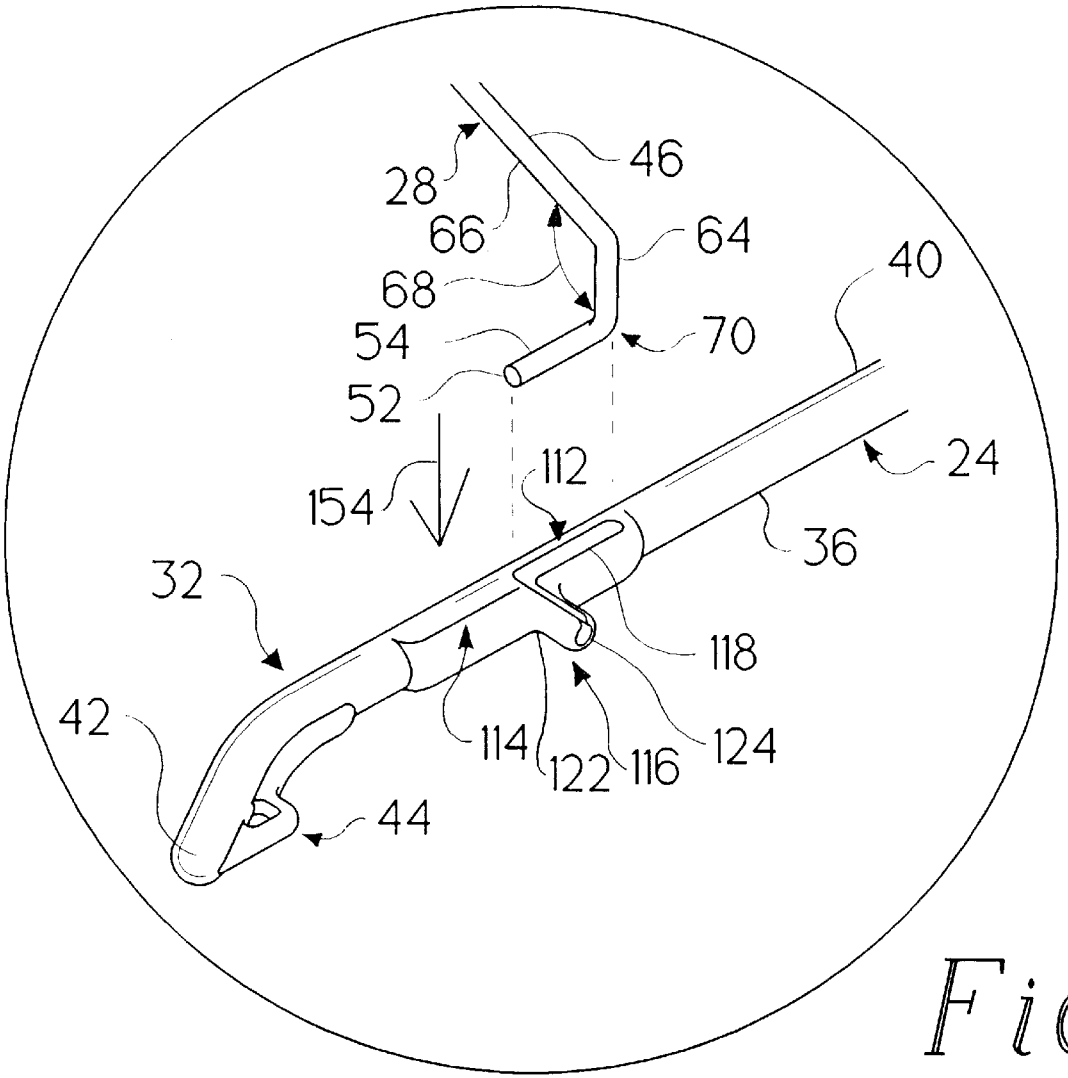
FIG. 5A is a perspective exploded view of the L-shaped portion of the landing gear strut being inserted into the loading channel formed in the landing gear skid.
Figure 5B:
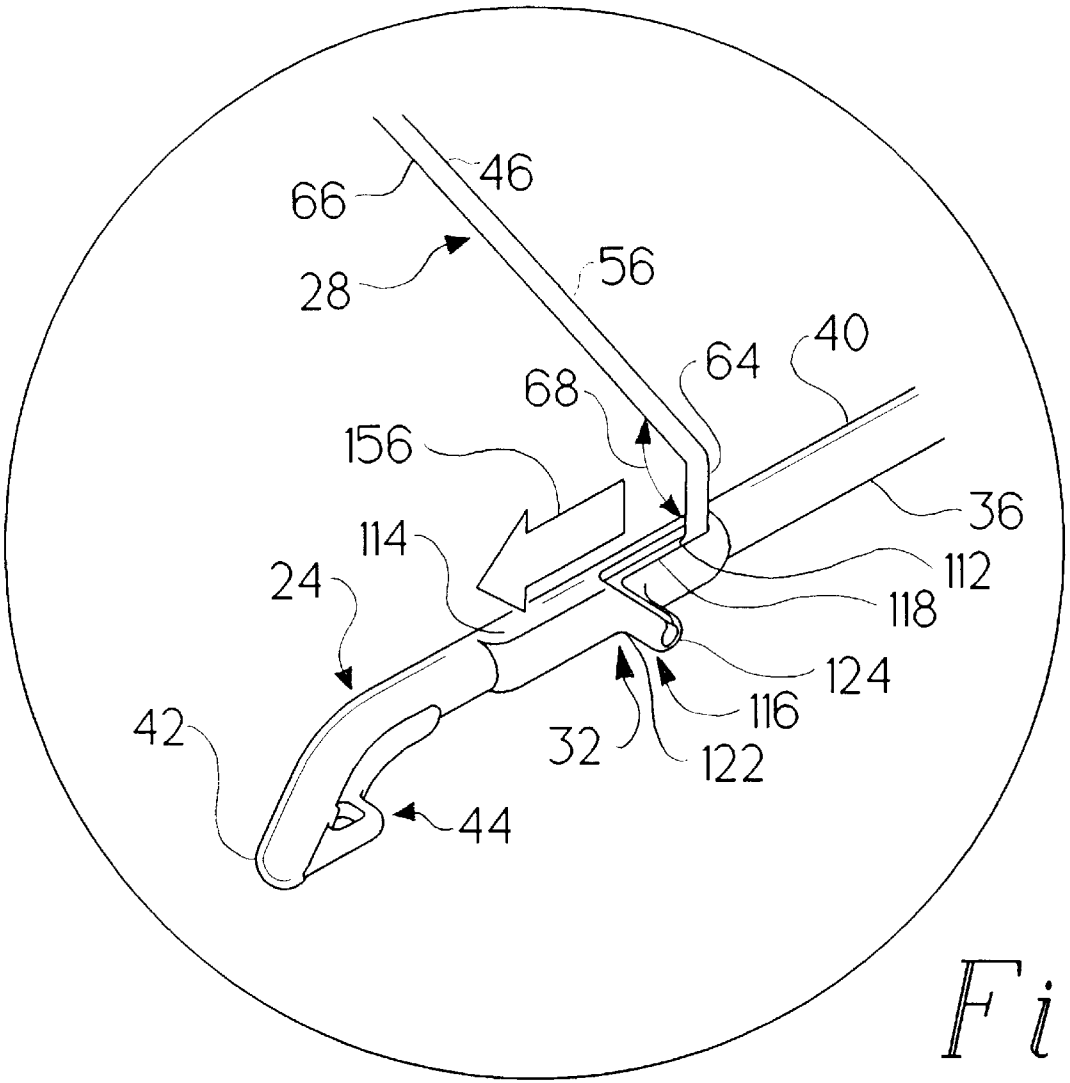
FIG. 5B is a perspective exploded view of the L-shaped portion of the landing gear strut sliding from the loading channel into the trapping channel formed in the landing gear skid.
Figure 5C:
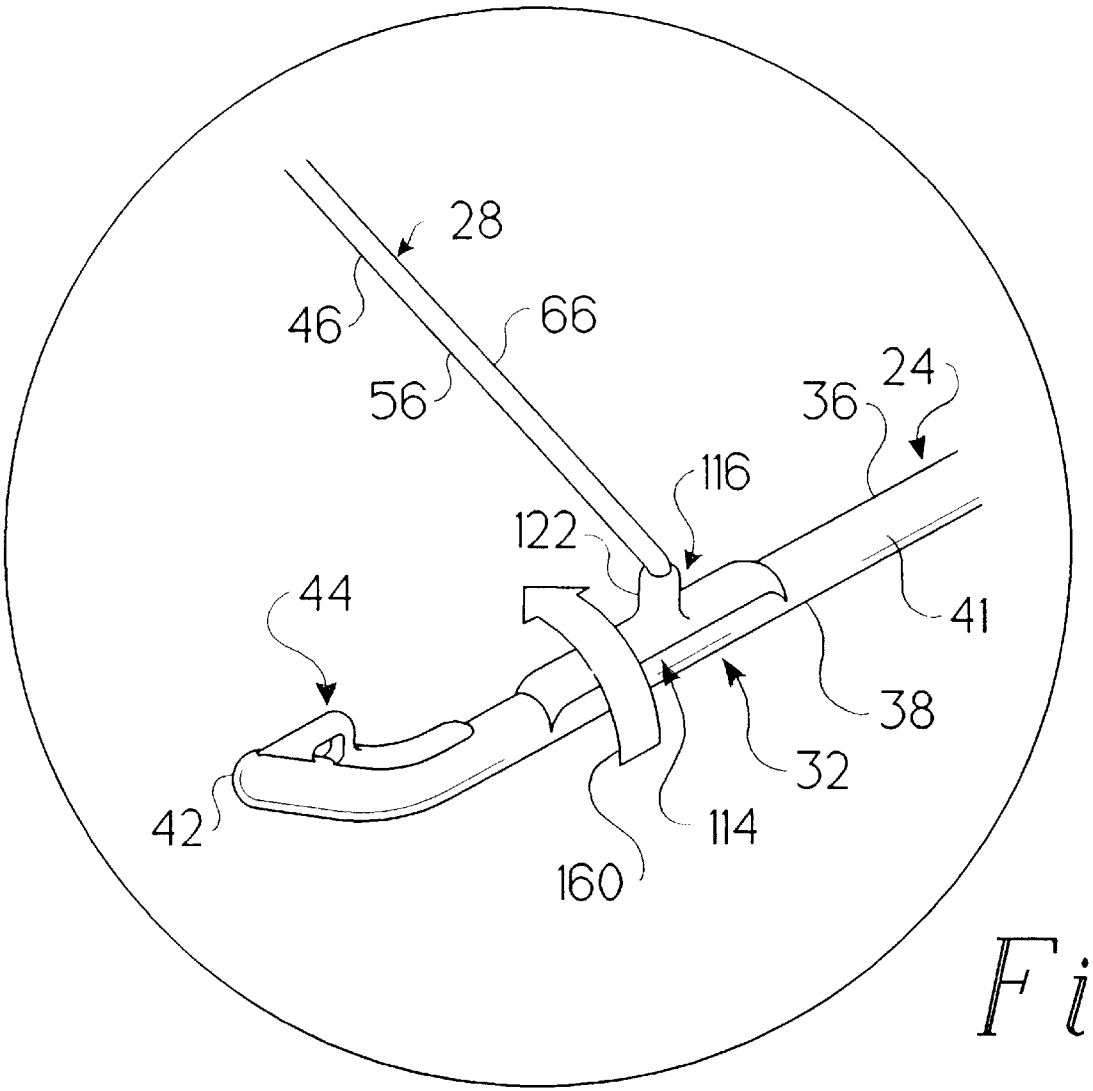

FIGS. 5–5C show how landing gear struts 28, 30 connect to landing gear skids 24, 26. Both foot portions 54 of front landing gear strut 28 connect to landing gear skids 24, 26 in the same manner. Foot portions 80 of rear landing gear strut 30 connect to landing gear skids 24, 26 in an almost identical manner as foot portions 54 of front landing gear strut 28. FIGS. 5A–5C show step-by-step how one foot portion 54 of front landing gear strut 28 attaches to landing gear skid 24. Any differences as to how foot portions 80 of rear landing gear strut 30 attach to landing gear skids 24, 26 are pointed out below.

First, foot portion 54 of front landing gear strut 28 is inserted in direction 154 into loading channel 118 as shown in FIG. 5A. Second, foot portion 54 is slid in direction 156 toward front end 42 of landing gear skid 24 into a trapping channel 120 as shown in FIG. 5B. During this second step, foot portion 80 of rear landing gear strut 30 is slid in direction 158 toward rear end 43 of landing gear skid 24, 26 into a trapping channel (not shown) of trapping segment 136. Third, landing gear skid 24 is rotated 90° in direction 160 about foot portion 54 to position lower section 64 of leg portion 56 of landing gear strut 28 in boot channel 124.

Leg portion 56 is secured in boot collar 122 through a snap-fit connection. Boot channel 124 includes a retaining channel 162 having a width 163 that is approximately equal to diameter 49 of landing gear strut 28, 30 and a narrower snap-fit channel 164 having a width 165 as shown in FIG. 4D. Snap-fit channel 164 expands slightly to accommodate entry of leg portion 56 into retaining channel 162 and then closes securely around leg portion 56 to secure landing gear strut 28 within landing gear skid 24. In preferred embodiments of the present invention, landing gear skids 24, 26 are made of a rigid, impact resistant plastic material such as nylon.

Figures 6, 6A, 6B, 6C:
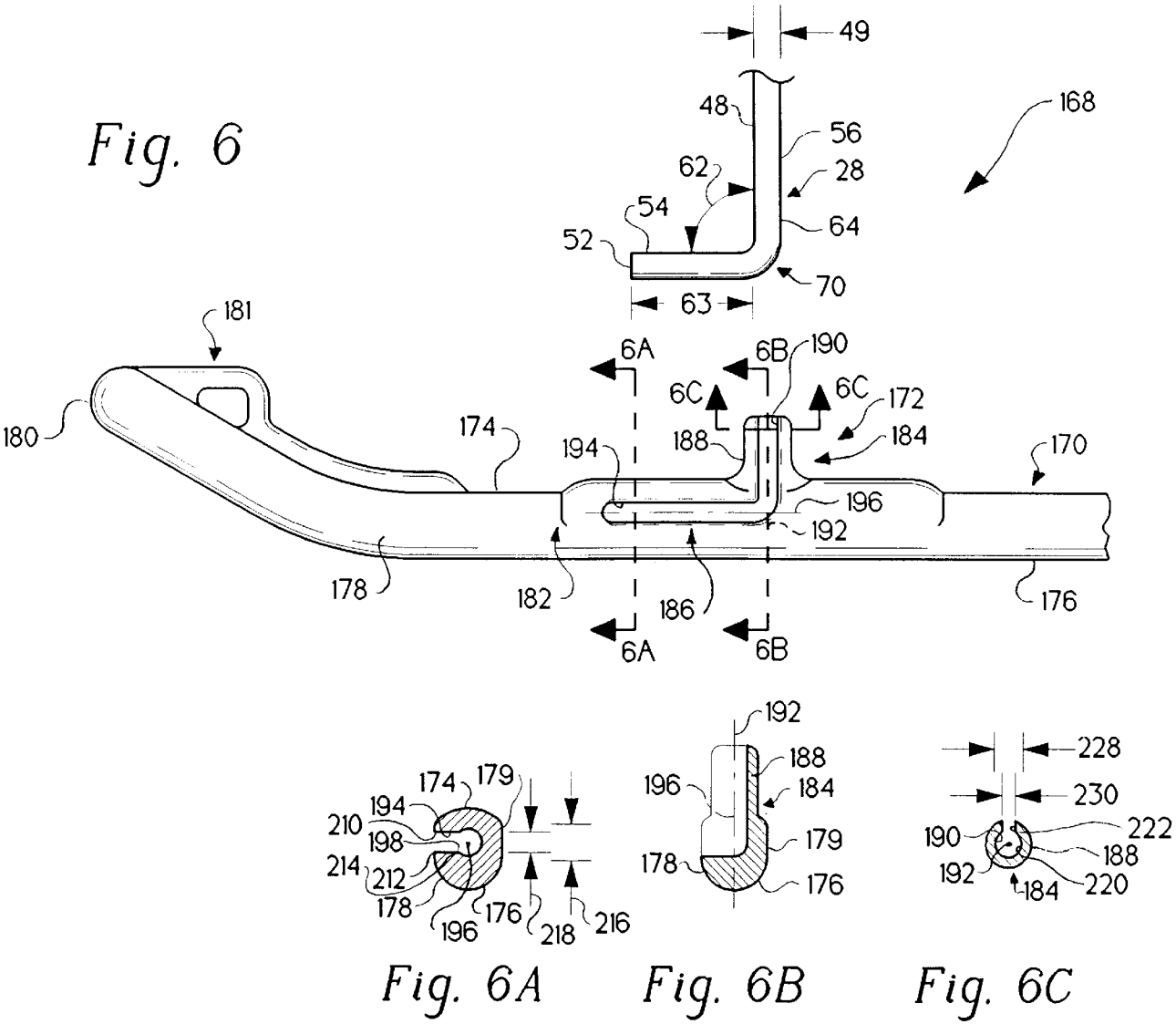
FIG. 6 is an enlarged side elevational view similar to FIG. 4 of another embodiment of a landing gear skid showing the landing gear skid being formed to include a landing gear strut attachment area defined by an L-shaped slot formed in the landing gear skid and an L-shaped portion of a landing gear strut that extends into the L-shaped slot formed in the landing gear skid.
FIG. 6A is a sectional view taken along line 6A—6A of FIG. 6 showing the landing gear strut attachment area including a loading/trapping channel formed in the landing gear skid and the loading/trapping channel including a snap-fit channel and a wider retaining channel.
FIG. 6B is a sectional view taken along line 6B—6B of FIG. 6 showing the landing gear strut attachment area including a boot extending upwardly toward the body of the helicopter and the boot including a collar and a boot channel extending through the collar.
FIG. 6C is a sectional view taken along line 6C—6C of FIG. 6 showing the boot channel including a snap-fit channel and a wider retaining channel.

Another preferred embodiment of a landing gear assembly 168 including landing gear struts 28, 30 and two landing gear skids 170, (other not shown) is shown in FIGS. 6–6C. The second landing gear skid (not shown) is identical to the illustrated landing gear skid 170. Landing gear skid 170 is formed to include a landing gear strut attachment area 172, a top surface 174 facing upwardly toward fuselage 22, a bottom surface 176 facing downwardly away from fuselage 22, side surfaces 178, 179 extending between top and bottom surfaces 174, 176, a front end 180, and a rear end (not shown) spaced apart from front end 180. Landing gear skid 170 also includes a tie down 181 as an aesthetic feature.

Landing gear skid 170 also includes a second landing gear strut attachment area (not shown) positioned to lie between first landing gear strut attachment area 172 and rear end (not shown) of landing gear skid 170. Second landing gear strut attachment area (not shown) differs from first landing gear strut attachment area 172 in the same manner as landing gear strut attachment areas 32, 34 of landing gear skid 24, 26 differ. Differences between landing gear strut attachment areas 172, (other not shown) will be mentioned below.

Landing gear strut attachment area 172 is defined by a L-shaped slot 182 configured to receive and retain L-shaped portion 70 of front landing gear strut 28 as shown, for example, in FIG. 6. Landing gear strut attachment area 172 includes an upright-connecting segment or boot 184 and a loading/trapping segment 186. Boot 184 includes a collar 188 and a boot channel 190 extending through collar 188 along an axis 192. Loading/trapping segment 186 is defined by a loading/trapping channel 194 formed in side surface 178 of landing gear skid 170. Loading/trapping channel 194 extends from boot channel 190 toward front end 180 of landing gear skid 170 along an axis 196 that is perpendicular to axis 192. In a second landing gear strut attachment area (not shown), the loading/trapping channel (not shown) extends from the boot channel (not shown) toward rear end (not shown) of landing gear skid 170. This is the only difference between landing gear strut attachment areas 172, (other not shown).

Loading/trapping channel 194 communicates with boot channel 190 to form L-shaped slot 182. Loading/trapping channel 194 includes a retaining channel 198 and a narrower snap-fit channel 210 having a first side 212 communicating with side surface 178 and a second side 214 communicating with retaining channel 198 as shown in FIG. 6A. Retaining channel 198 includes a width 216 that is approximately equal to diameter 49 of landing gear struts 28, 30. Snap-fit channel 210 includes a width 218 that is less than width 216 of retaining channel 198. Boot channel 190 also includes a retaining channel 220 and a narrower snap-fit channel 222 having a first side 224 communicating with side surface 178 and a second side 226 communicating with retaining channel 220. Retaining channel 220 includes a width 228 that is approximately equal to diameter 49 of landing gear struts 28, 30. Snap-fit channel 222 includes a width 230 that is less than width 228 of retaining channel 220.

L-shaped portion 70 of landing gear strut 28 connects to landing gear skid 170 in a simple one-step operation. L-shaped portion 70 is simply snap-fit into L-shaped slot 182 formed in landing gear skid 170. When L-shaped portion 70 is loaded into L-shaped slot 182, snap-fit channels 210, 222 of boot channel 190 and loading/trapping channel 194, respectively, expand slightly to permit L-shaped portion 70 to pass through snap-fit channels 210, 222 and then close securely around L-shaped portion 70 when L-shaped portion 70 is received within retaining channels 198, 220 of boot channel 190 and loading/trapping channel 194, respectively.

Figures 7, 7A:
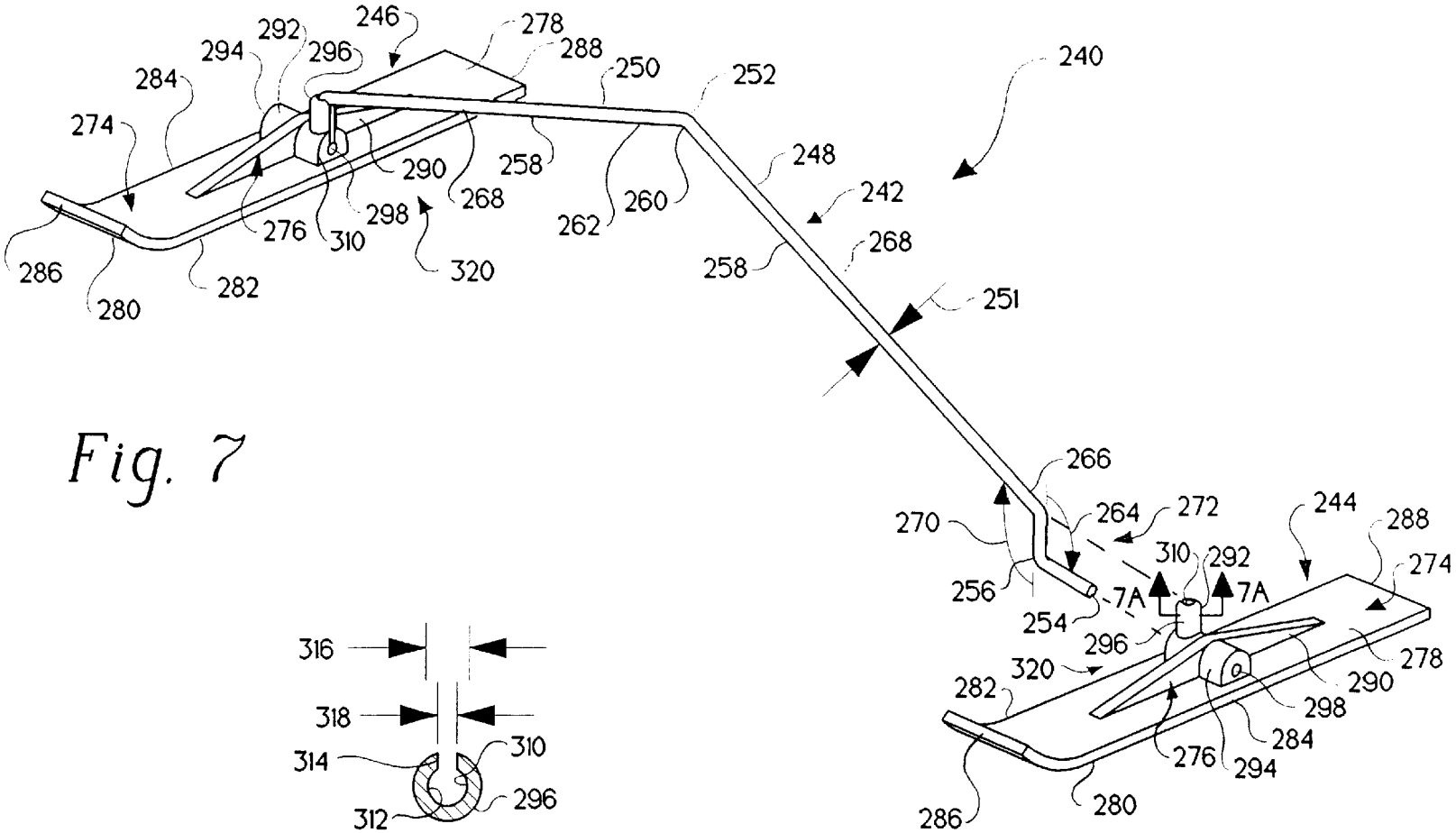
FIG. 7 is a perspective view of yet another embodiment of a landing gear assembly including a pair of landing gear ski skids and a landing gear strut connected to the pair of landing gear ski skids.
FIG. 7A is a sectional view taken along line 7A—7A of FIG. 7 showing a channel formed in the landing gear ski skids and the channel including a snap-fit channel.

Another preferred embodiment of a landing gear assembly 240 according to the present invention is shown in FIG. 7. Landing gear assembly 240 includes a single landing gear strut 242 and a pair of landing gear ski skids 244, 246 connected to landing gear strut 242.

Landing gear strut 242 includes a first side 248 connected to landing gear ski skid 244, a second side 250 connected to landing gear ski skid 246, and a diameter 251 as shown in FIG. 7. Each of the first and second sides 248, 250 includes a proximal end 252, a distal end 254 spaced apart from proximal end 252 and defining a foot portion 256, and a leg portion 258 extending between proximal end 252 and distal end 254. Landing gear strut 242 is an inverted V-shaped and proximal end 252 of first side 248 is connected to proximal end 252 of second side 250 to define a vertex 260 of V-shaped landing gear strut 242. Proximal ends 252 of first and second sides 248, 250 define a fuselage-connecting portion 262 of landing gear strut 242.

Foot portion 256 extends substantially perpendicular from leg portion 258 in the same plane as leg portion 258 to define an included angle 264 of approximately 90° as shown, for example, in FIG. 7. Leg portion 258 includes a lower section 266 positioned to lie adjacent to foot portion 256 and an upper section 268 spaced apart from lower section 266 and positioned to lie adjacent to fuselage-connecting portion 262. The lower section 266 of leg portion 258 is connected to upper section 268 of leg portion 258 to define an included angle 270 of approximately 115°. The lower section 266 of leg portion 258 and foot portion 256 form an L-shaped portion 272. Landing gear strut 242 is identical to landing gear strut 28 shown in FIGS. 4, 5, and 6 except that landing gear strut 242 includes a foot portion 256 that lies in the same plane as leg portion 258 and fuselage-connecting portion 262.

Landing gear ski skids 244, 246 each include a ski portion 274 and a landing gear strut attachment area 276 connected to ski portion 274 as shown in FIG. 7. Ski portion 274 includes a top surface 278, a bottom surface 280, side surfaces 282, 284 extending between top and bottom surfaces 278, 280, a front end 286, and a rear end 288. Landing gear strut attachment area 276 includes a triangular-shaped reinforcing portion 290 connected to top surface 278 of ski portion 274 and an L-shaped boot 292 connected to top surface 278 of ski portion 274 and triangular-shaped reinforcing portion 290.

L-shaped boot 292 includes a lower horizontally-extending section 294 connected to top surface 278 of ski portion 274 and an upper vertically-extending section 296 connected to horizontally-extending section 294. Horizontally-extending section 294 is formed to include a horizontally-extending channel 298 and vertically-extending section 296 is formed to include a vertically-extending channel 310 communicating with horizontally-extending channel 298. Vertically-extending channel 310 includes a retaining channel 312 and a narrower snap-fit channel 314 as shown in FIG. 7A. Retaining channel 312 includes a width 316 that is approximately equal to diameter 251 of landing gear strut 242. Snap-fit channel 314 includes a width 318 that is less than width 316 of retaining channel 312. Horizontally-extending channel 298 and vertically-extending channel 310 comprise a L-shaped slot 320 configured to receive L-shaped portion 272 of landing gear strut 242.

L-shaped portion 272 of landing gear strut 242 connects to landing gear ski skids 244, 246 in a simple one-step operation. L-shaped portion 272 is simply snap-fit into L-shaped slot 320 formed in L-shaped boot 292 of landing gear skid 244, 246. Foot portion 256 is slid into horizontally-extending channel 298 and lower section 266 of leg portion 258 is snap-fit into vertically-extending channel 310. When L-shaped portion 272 is loaded into L-shaped slot 320, snap-fit channel 314 of vertically-extending channel 310 expands slightly to permit L-shaped portion 272 to pass through snap-fit channel 314 and then closes securely around L-shaped portion 272 when L-shaped portion 272 is received within retaining channel 312 of vertically-extending channel 310.

The landing gear assemblies 20, 168, 240 discussed above all include a snap-fit connection between the landing gear struts and the landing gear skids. This snap-fit connection provides easy assembly, disassembly, and repair of landing gear assemblies 20, 168, 240.

Another feature of landing gear assemblies 20, 168, 240 is that the foot portion of the landing gear struts extends into a slot formed in the landing gear skids. Because the foot portion extends into the landing gear skids, forces acting on the landing gear struts are transferred into and distributed within the landing gear skids. In addition, the portion of the landing gear strut that is received and retained within the landing gear skids reinforces and strengthens the landing gear skids at the location where forces are transferred between the landing gear skids and the landing gear struts. No point contact between the landing gear struts and landing gear skids occurs because the length of the foot portion is greater than the diameter of the leg portion.

Figure 8:
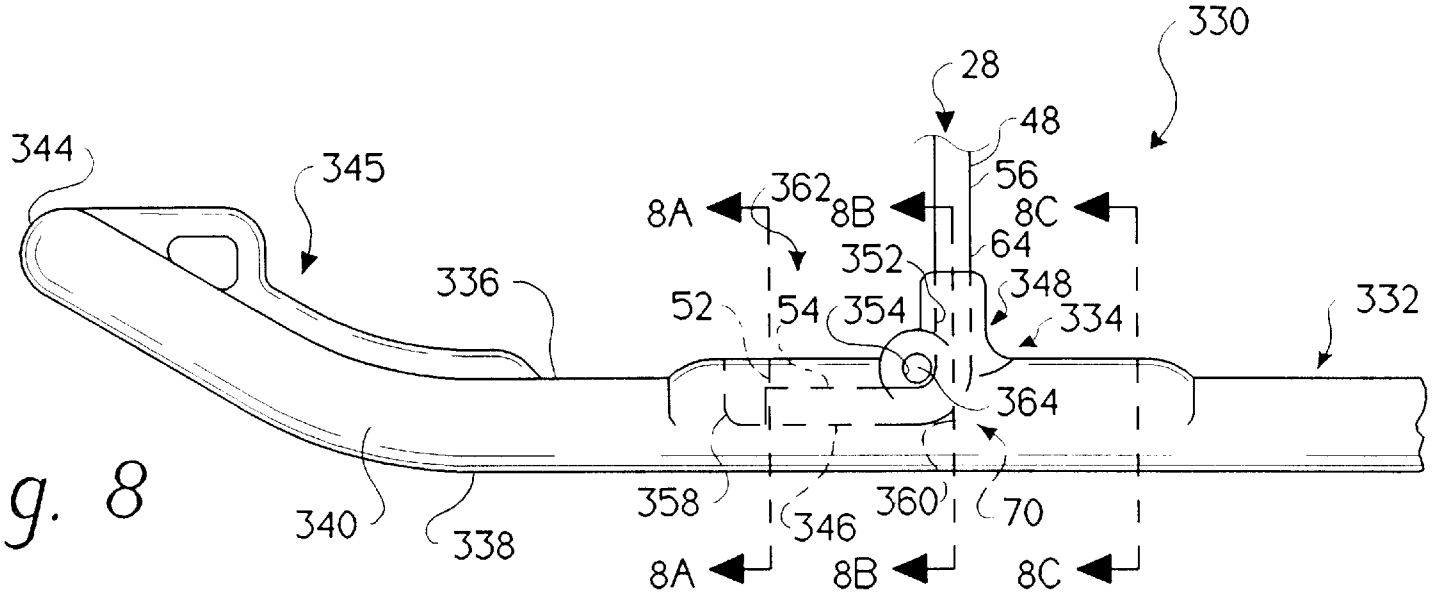
FIG. 8 is an enlarged side elevational view similar to FIGS. 4 and 6 of yet another embodiment of a landing gear skid showing the landing gear skid being formed to include a landing gear strut attachment area defined by an L-shaped slot formed in the landing gear skid, an L-shaped portion of a landing gear strut extending into the L-shaped slot formed in the landing gear skid, and a locking pin extending across the L-shaped slot to hold the landing gear strut and landing gear skid together.
Figure 9:
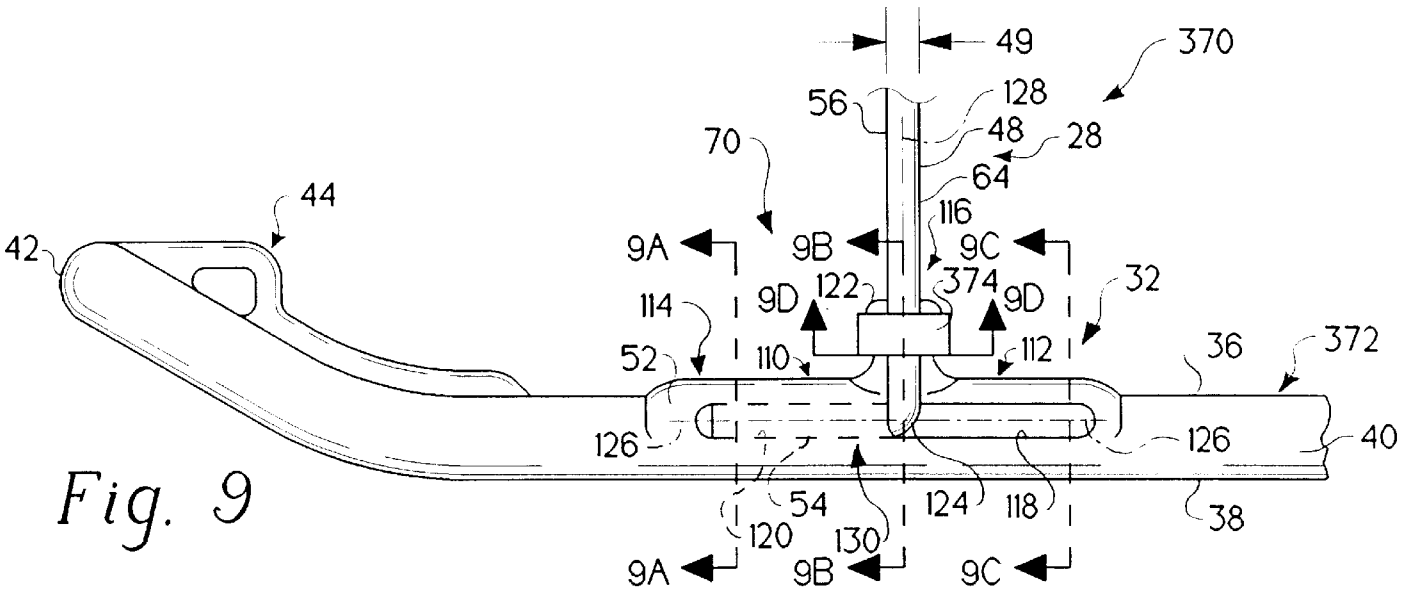
FIG. 9 is an enlarged side elevational view similar to FIGS. 4, 6, and 8 of yet another embodiment of a landing gear skid showing the landing gear skid being formed to include a landing gear strut attachment area defined by an inverted T-shaped slot, a L-shaped portion of a landing gear strut lying in the inverted T-shaped slot, and a cable tie holding the landing gear strut and landing gear skid together.
Figure 10:
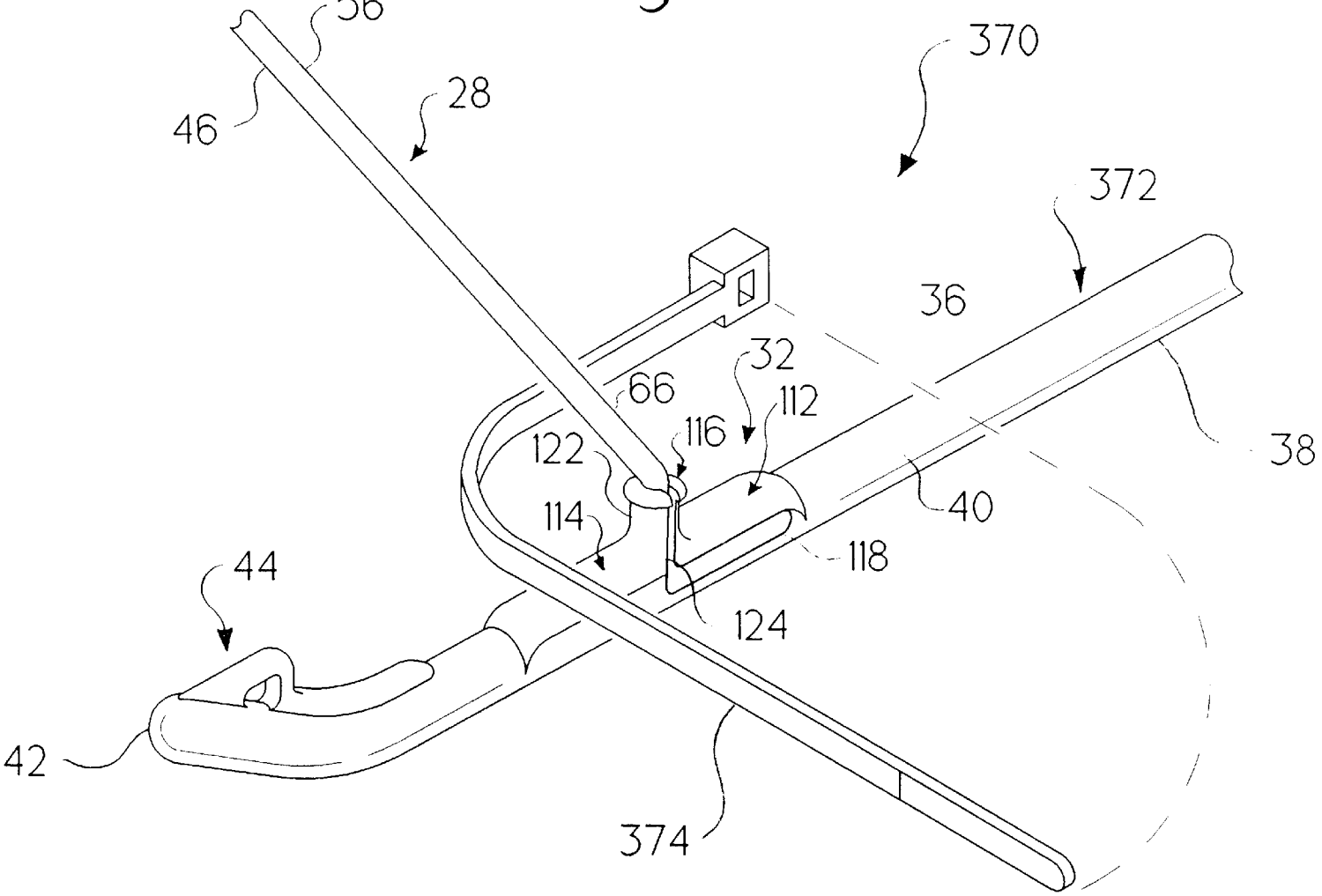
FIG. 10 is an enlarged perspective view of the cable tie as it is being wrapped around the collar of the boot to hold a landing gear strut and landing gear skid together.

In some instances, it may be desirable to make the landing gear skids from a material that is not suitable for snap-fit connections. Even though the snap-fit connection cannot be used in such instances, it would be desirable to provide a landing gear skid formed to include a slot to receive the landing gear struts within the landing gear skids, or formed to include a landing gear strut attachment area receptive to an angled foot of a landing gear strut. FIGS. 8–10 show two embodiments of the present invention including landing gear assemblies having a locking or holding element used to hold the landing gear strut within a slot formed in the landing gear skid in the absence of a snap-fit connection between the landing gear strut and landing gear skid.

Figure 8C:
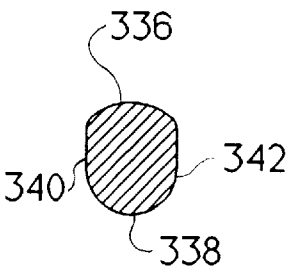
FIG. 8C is a sectional view taken along line 8C—8C of FIG. 8 showing that no channel is formed in this portion of the landing gear skid.
Figure 8B:
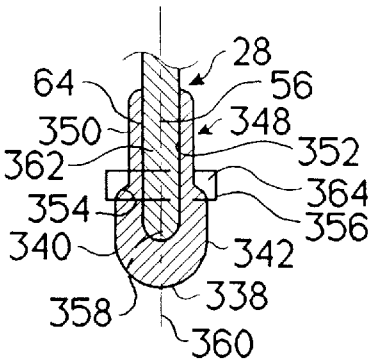
FIG. 8B is a sectional view taken along line 8B—8B of FIG. 8 showing the landing gear strut attachment area including a boot extending upwardly toward the body of the helicopter, the boot including a collar and boot slot extending through the collar and communicating with the horizontally-extending slot, the L-shaped portion of the landing gear strut lying in the boot slot and horizontally-extending slot, and the locking pin extending across the boot slot and horizontally-extending slot to hold the landing gear strut and the landing gear skid together.
Figure 8A:
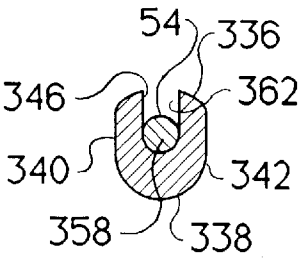
FIG. 8A is a sectional view taken along line 8A—8A of FIG. 8 showing the landing gear strut attachment area including a horizontally-extending slot formed in the landing gear skid and the foot portion of the landing gear strut lying in the horizontally-extending slot.

A preferred embodiment of a landing gear assembly 330 according to the present invention is shown in FIGS. 8–8C. Landing gear assembly 330 includes landing gear struts 28, 30 and two landing gear skids 332, (other not shown). The second landing gear skid (not shown) is identical to the illustrated landing gear skid 332.

Landing gear skid 332 is formed to include a landing gear strut attachment area 334, a top surface 336 facing upwardly toward fuselage 22, a bottom surface 338 facing downwardly away from fuselage 22, side surfaces 340, 342 extending between top and bottom surfaces 336, 338, a front end 344, a rear end (not shown) spaced apart from front end 344, and a tie down 345 situated adjacent to front end 344. Landing gear skid 332 also includes a second landing gear strut attachment area (not shown) positioned to lie between first landing gear strut attachment area 334 and the rear end (not shown) of landing gear skid 332. The second landing gear strut attachment area (not shown) differs from first landing gear strut attachment area 334 in the same manner as landing gear strut attachment areas 32, 34 of landing gear skids 24, 26 differed. Differences between landing gear strut attachment areas 334, (other not shown) will be discussed below.

Landing gear strut attachment area 334 includes a horizontally-extending channel 346 formed in top surface 336 of landing gear skid 332 and a boot 348 having a collar 350, a boot channel 352 extending through collar 350, and spaced-apart locking pin-receiving apertures 354, 356 formed adjacent to horizontally-extending channel 346 and boot channel 352. Horizontally-extending channel 346 extends along an axis 358 from boot channel 352 toward front end 344 of landing gear skid 332. Second landing gear strut attachment area (not shown) is identical to landing gear strut attachment area 334 except that horizontally-extending channel (not shown) extends from boot channel (not shown) toward rear end (not shown) of landing gear skid 332. Boot channel 352 extends along an axis 360 that is substantially perpendicular to axis 358. Boot channel 352 and horizontally-extending channel 346 comprise a L-shaped slot 362 which is sized to receive L-shaped portion 70 of landing gear strut 28.

Landing gear assembly 330 further includes a locking pin 364 that extends through spaced-apart locking pin-receiving apertures 354, 356 and across L-shaped slot 362 to retain L-shaped portion 70 of landing gear strut 28 within landing gear skid 332. Landing gear strut 28 connects to landing gear skid 332 by simply inserting L-shaped portion 70 of landing gear strut 332 into L-shaped slot 362 formed in landing gear skid 332 and then inserting locking pin 364 through spaced-apart locking pin-receiving apertures 354, 356.

Figure 9D:
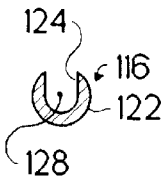
FIG. 9D is a sectional view taken along line 9D—9D of FIG. 9 showing the boot channel extending through the collar of the boot.
Figure 9C:
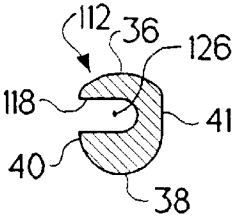
FIG. 9C is a sectional view taken along line 9C—9C of FIG. 9 showing the landing gear strut attachment area including a loading channel formed in the landing gear skid.
Figure 9B:
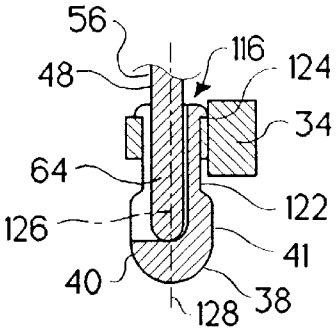
FIG. 9B is a sectional view taken along line 9B—9B of FIG. 9 showing the landing gear strut attachment area including a boot, the boot including a collar and a boot channel extending through the collar, the L-shaped portion of the landing gear strut lying in the boot channel, and the cable tie wrapped around the collar to hold the landing gear strut and the landing gear skid together.
Figure 9A:
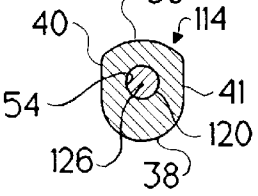
FIG. 9A is a sectional view taken along line 9A—9A of FIG. 9 showing the landing gear strut attachment area including a trapping channel formed in the landing gear skid and the L-shaped portion of the landing gear strut lying in the trapping channel.

Another preferred embodiment of a landing gear assembly 370 according to the present invention is shown in FIGS. 9–10. Landing gear assembly 370 includes landing gear struts 28, 30 and two landing gear skids 372, (other not shown). Landing gear skids 372, (other not shown) are identical to landing gear skids 24, 26 except that boot channel 124 of landing gear skids 372, (other not shown) do not include a separate snap-fit channel 164 and retaining channel 162 to provide a snap-fit connection as does boot channel 124 of landing gear skids 24, 26 as shown in FIGS. 4D and 9D. All reference numbers for elements of landing gear skids 24, 372 are identical except for the above-mentioned exception.

Landing gear assembly 370 further includes a cable tie 374 used as a locking element to secure landing gear strut 28 within landing gear skid 372. To connect landing gear strut 28 to landing gear skid 372, L-shaped portion 70 of landing gear strut 28 is inserted into landing gear strut attachment area 32 of landing gear skid 372 in the same manner as landing gear strut 28 is inserted into landing gear strut attachment area 32 of landing gear skid 24 as discussed above and shown in FIGS. 5A–5C. Landing gear strut 30 is connected to landing gear skid 372 in the same manner as described above in connection with landing gear skid 24. The only difference between the connection of landing gear strut 28 to landing gear skid 372 and landing gear strut 28 to landing gear skid 24 is that a snap-fit connection is not achieved in the connection of landing gear strut 28 and landing gear skid 372. To replace the snap-fit connection, cable tie 374 is wrapped and tightened around collar 122 of boot 116 to secure landing gear strut 24 to landing gear skid 372.

Cable ties 374 have advantages over other types of fasteners such as bolts because cable ties 374 are made of a plastic material such as nylon and so are lower in weight than metal fasteners, are easily installed, are small in size, and are able to simultaneously surround and bind parts together (this function normally requires a separate bolt and bracket).

In alternative embodiments of the present invention, a landing gear assembly (not shown) is provided including first and second spaced-apart landing gear skids (not shown) and front and rear landing gear struts (not shown) having first and second common foot portions (not shown) arranged so that the first common foot portion engages the first landing gear skid and the second common foot portion engages the second landing gear skid. Each of the front and rear landing gear struts also include first and second legs arranged so that the first legs extend toward the first landing gear skid and the second legs extend toward the second landing gear skid. The common foot portions of the front and rear landing gear struts extend through the first and second landing gear skids (not shown) so that the first common foot portion connects the first leg portions of the front and rear struts and the second common foot portion connects the second leg portions of the front and rear struts. The common foot portions (not shown) strengthen and stiffen the landing gear skids (not shown).

In another alternative embodiment of the present invention, a landing gear assembly (not shown) is provided including a one-piece plastic skid molded directly to the distal end of a landing gear strut (not shown) in an insert-molding operation. The one-piece landing gear skid/strut (not shown) is preferably made of a plastics material in an insert-molding operation. The one-piece landing gear skid/strut (not shown) is very strong and compact, but is not removable for maintenance or easy replacement.

Landing gear assemblies 20, 168, 240, 330, 370 may be used on other types of model aircraft, including for instance, airplanes and gyro-kites. In addition, landing gear assemblies 20, 168, 240, 330, 370 may be adapted to types of landing gear assemblies (not shown) that include landing gear floats or landing gear wheels instead of landing gear skids or landing gear ski skids.

The remaining portion of this detailed description discusses landing gear assembly 20 with the understanding that landing gear assemblies 168, 240, 330, 370 can be interchanged with and substituted for landing gear assembly 20. In FIGS. 11–18, which illustrate the structural details of the helicopter 10, fuselage 22 forms the structural backbone of helicopter 10 and is connected to landing gear assembly 20. The same fuselage 22 also connects to landing gear assemblies 168, 240, 330, 370.

FIGS. 11A–11F show individual fuselage 22 structural elements comprising keel 410, landing gear bracket 412, fire wall left and right halves 414 and 416, landing gear bulkhead 418, bulkhead reinforcement 420, and floor 422.

Landing gear bracket 412 and landing gear bulkhead 418 support landing gear assembly 20 as shown in FIG. 3. Landing gear assembly 20 is rigidly mounted to fuselage 22 with cable ties 88. Fuselage-connecting portion 60 of front landing gear strut 28 abuts the rearward face 424 of landing gear bulkhead 418 and the lower edge 426 of bulkhead reinforcement 420 connects landing gear bulkhead 418 as shown in FIG. 1D. Bulkhead reinforcement 420 and landing gear bulkhead 418 are formed to include cable tie-receiving apertures 428 through which cable ties 88 extend as shown, for example, in FIGS. 3, 11C, and 11D. Fuselage-connecting portion 86 of rear landing gear strut 30 abuts bottom edge 430 of landing gear bracket 412. Landing gear bracket 412 is formed to include a cable tie-receiving aperture 432 and a cable tie-receiving slot 434 through which cable ties 88 extend as shown, for example, in FIGS. 3 and 11F.

Illustratively, main rotor 12 includes a pair of rotor blades 436 and a pair of shorter subrotor™ stabilizing rotor blades 438, and tail rotor 16 includes a pair of tail rotor blades 440. A gyro stabilizer 442 including a pair of aerodynamic gyro paddles 444 is mounted on tail rotor 16 as shown in FIG. 1.

Tail rotor 16 is mounted at a rear end of tail boom 446 as shown in FIGS. 1 and 2. Both main rotor 12 and tail rotor 16 are driven by an engine 448 usually located within fuselage 22 near a vertical main rotor shaft 450 of main rotor 12. A detailed description of a suitable helicopter main rotor system is disclosed in Paul E. Arlton's U.S. patent application Ser. No. 08/233,159 filed Apr. 25, 1994 and Paul E. and David J. Arlton's U.S. Pat. Ser. No. 08/729,184 filed Oct. 11, 1994, which are hereby incorporated by reference herein. A detailed description of suitable tail rotor systems are disclosed in U.S. Pat. Nos. 5,305,968 and 5,597,138 to Paul E. Arlton and in a Paul E. Arlton U.S. patent application Ser. No. 08/687,649 filed Jul. 26, 1996, which are hereby incorporated by reference herein.

A streamlined canopy 452 covers a front portion of helicopter 10 and includes a body 454, gear shroud 456, and main rotor shroud 458 as shown in FIG. 1. A radio-controlled command unit and other drive mechanisms are contained inside canopy 452 as shown in FIG. 2. Canopy 452 is designed for use on a model helicopter such as helicopter 10 to protect the radio-control unit and provide the appearance of a pilot-carrying portion of helicopter 10. Canopy 452 does not extend back to tail rotor 16 on some helicopters 10.

In operation, main rotor 12 rotates rapidly about main rotor axis 14 in rotation direction 460. As it does so, main rotor blades 436 act like propellers or fans moving large amounts of air downward thereby creating a force that lifts helicopter 10 upward. The torque (reaction force) created by rotating main rotor 12 in rotation direction 460 tends to cause the body of helicopter 10 to swing about main rotor axis 14 in direction 462 as shown in FIG. 1. When trimmed for steady hovering flight, tail rotor 16 creates enough thrust force to cancel exactly the torque produced by main rotor 12 so that helicopter 10 can maintain a constant heading. Decreasing or increasing the thrust force of tail rotor 16 causes helicopter 10 to turn (rotate about main rotor axis 14) in the desired direction.

Components used to control main rotor 12, tail rotor 16, and engine 448 are shown in FIG. 2 which shows helicopter 10 of FIG. 1 with canopy 452 removed. To control model helicopter 10, a pilot manipulates small joysticks on a hand-held radio transmitter (not shown) to send commands to radio receiver 464 through antenna 466 and antenna wire 468. Radio receiver 464 is usually wrapped in vibration-absorbing foam 470. Radio receiver 464 relays these commands to electro-mechanical servo actuators 472 (hereinafter called servos) to control main rotor 12, tail rotor 16, and engine 448. Battery 474 provides the electrical power necessary to operate radio receiver 464 and servos 472. Rubber bands 476 encircle battery 474 and receiver 464 and secure them to helicopter 10.

Figure 17:
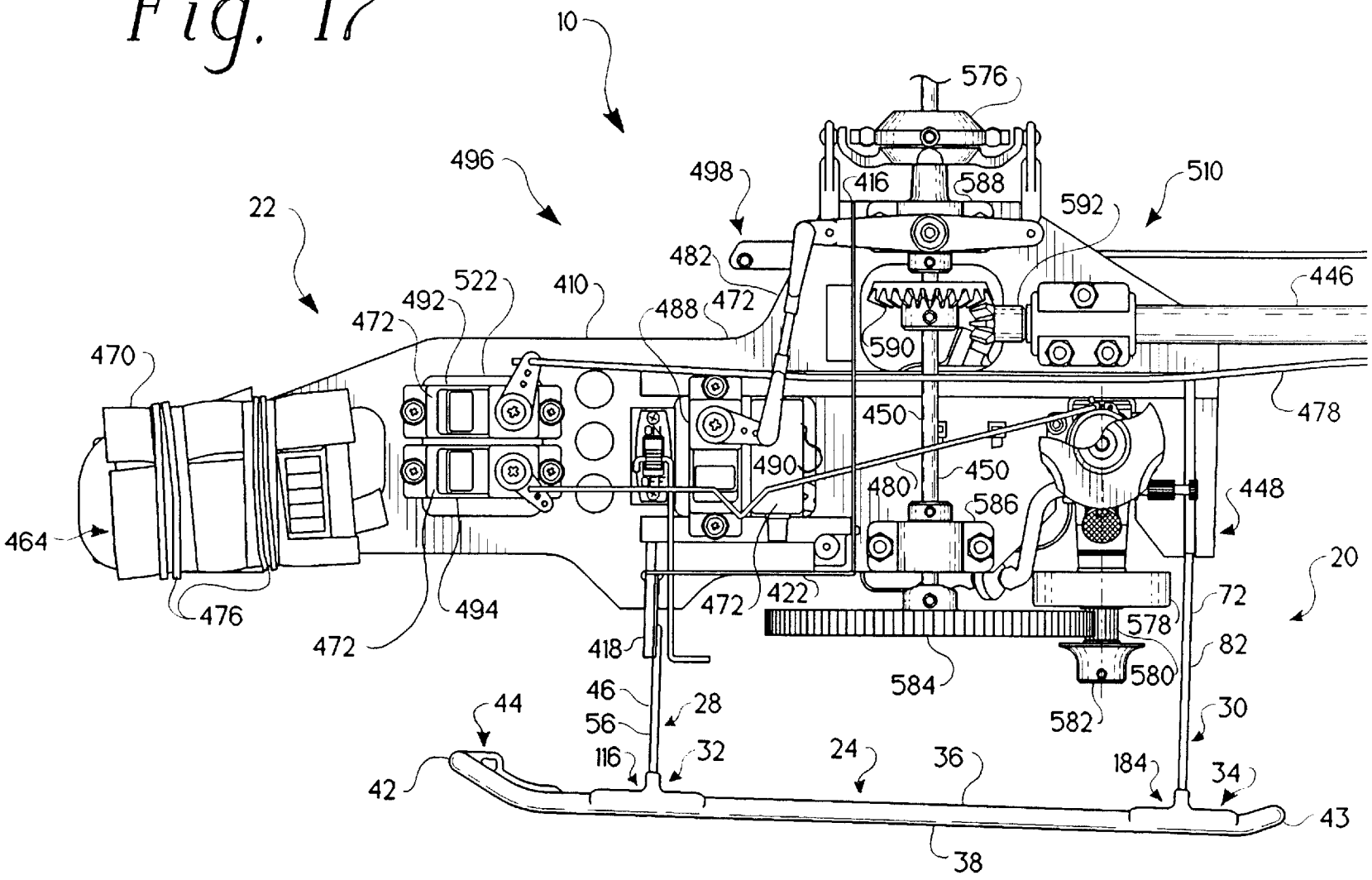
FIG. 17 is a left side elevation view of the model helicopter of FIGS. 1 and 2 showing the elongated, flat, vertical keel and relative positions of radio system components, drive train components and structural components along with the vertical main rotor shaft, horizontal tail boom, and landing gear wherein the engine heat sink is shown in partial cutaway to expose throttle pushrod detail and electrical wiring between radio components is omitted for clarity.
Figure 18:
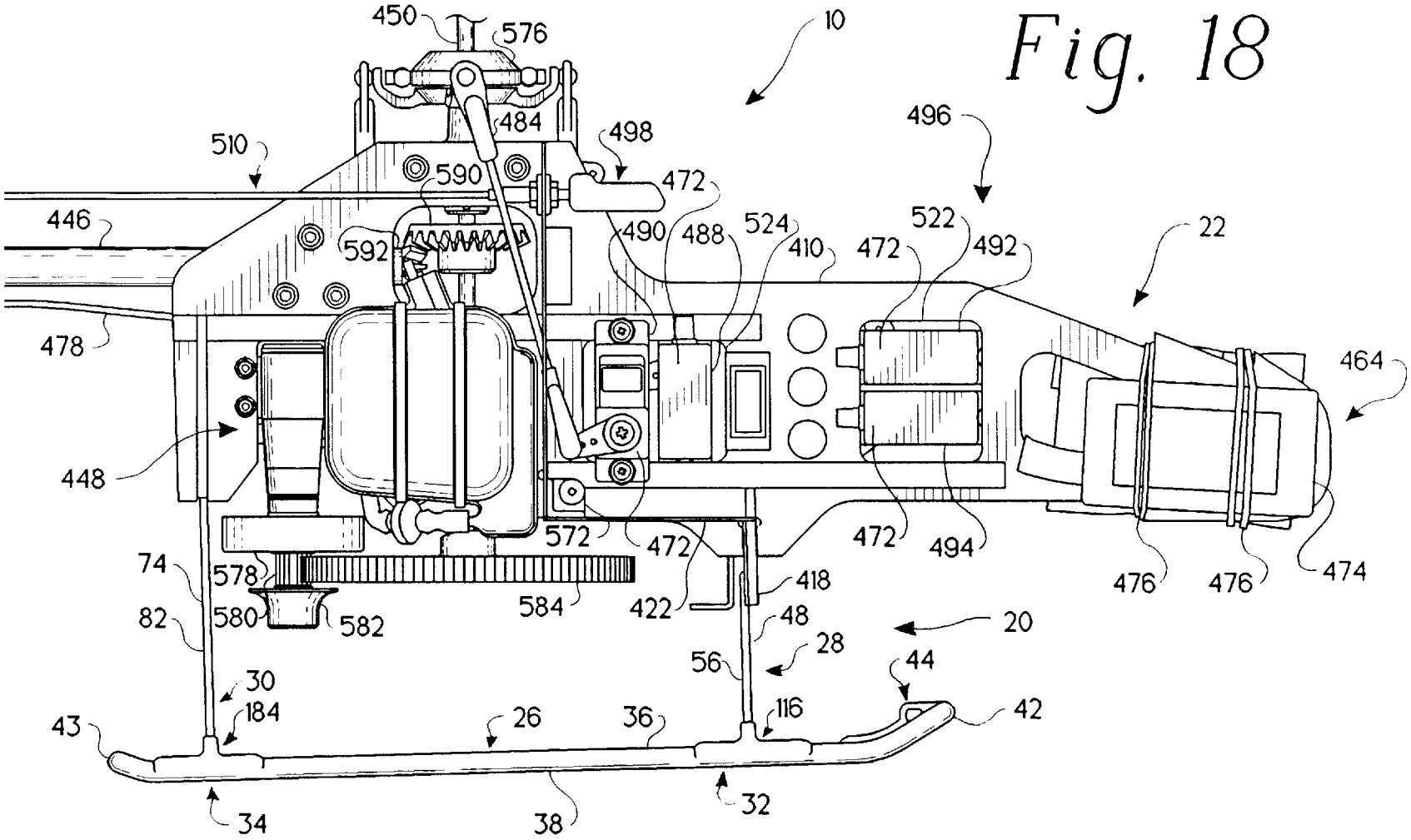
FIG. 18 is a right side elevational view of the model helicopter of FIGS. 1 and 2 showing relative positions of radio system components, drive train components, structural components, and fuel system components, wherein electrical wiring between radio components is omitted for clarity and landing gear attachment detail is also removed for clarity.
Figure 19:
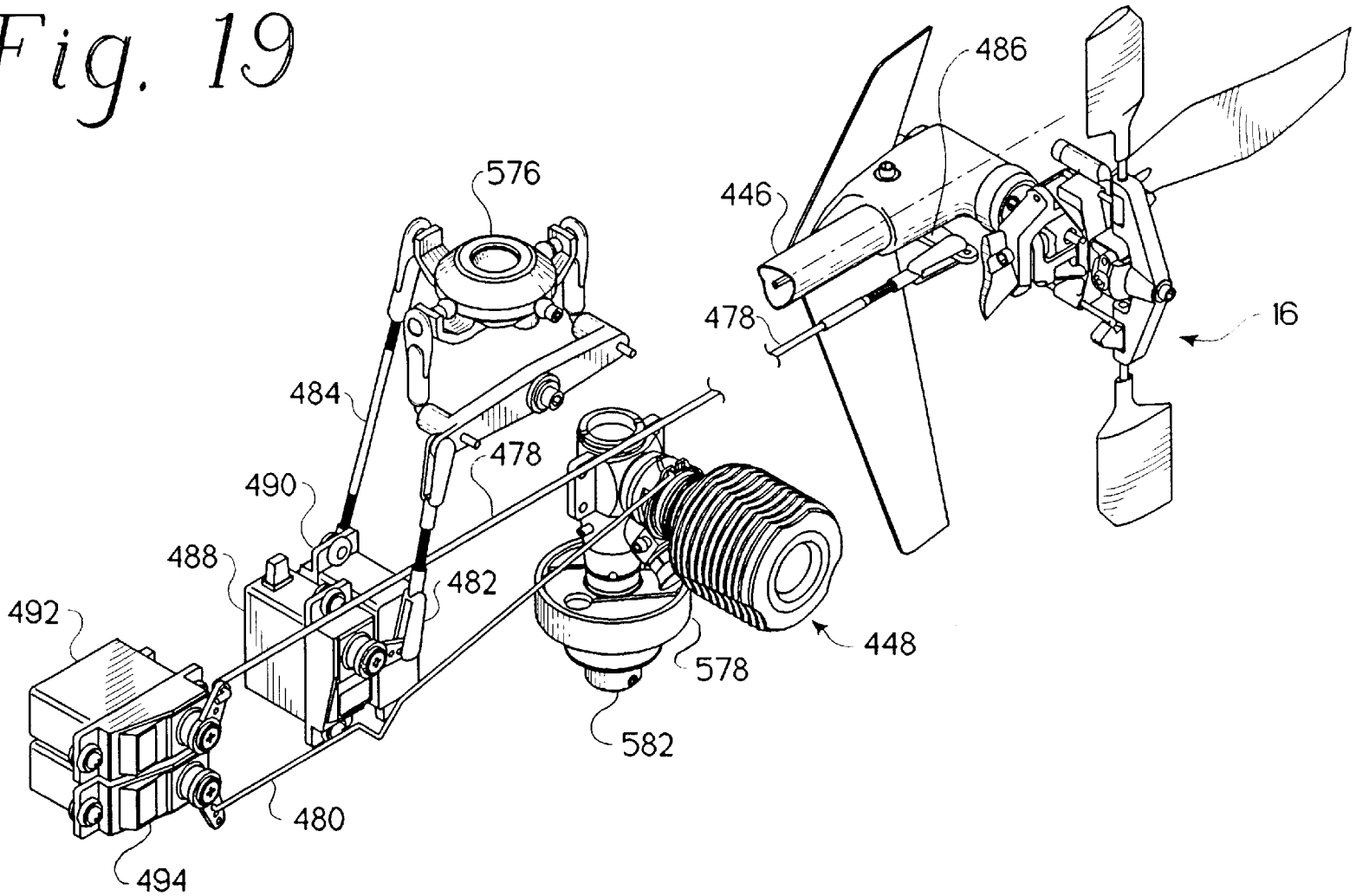
FIG. 19 is a perspective view of linkage system in accordance with the present invention showing elements of the radio system, swashplate (main rotor head control system), engine and tail rotor, with all structural elements removed for clarity.
Figure 20B:
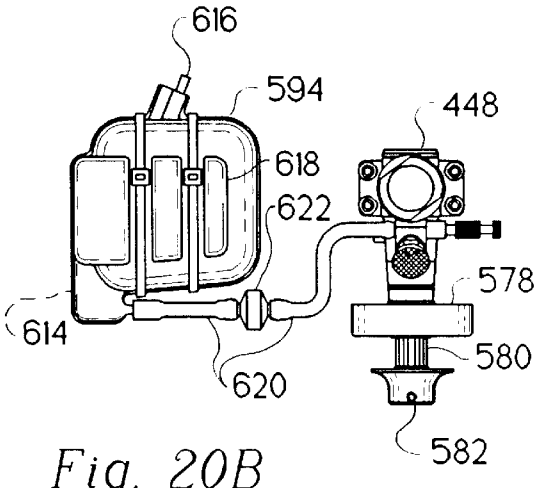
FIG. 20B is a side elevation view of the engine and fuel tank of a model helicopter in accordance with the present invention, with the engine heat sink and all other parts of the present invention omitted for clarity.
Figure 20A:
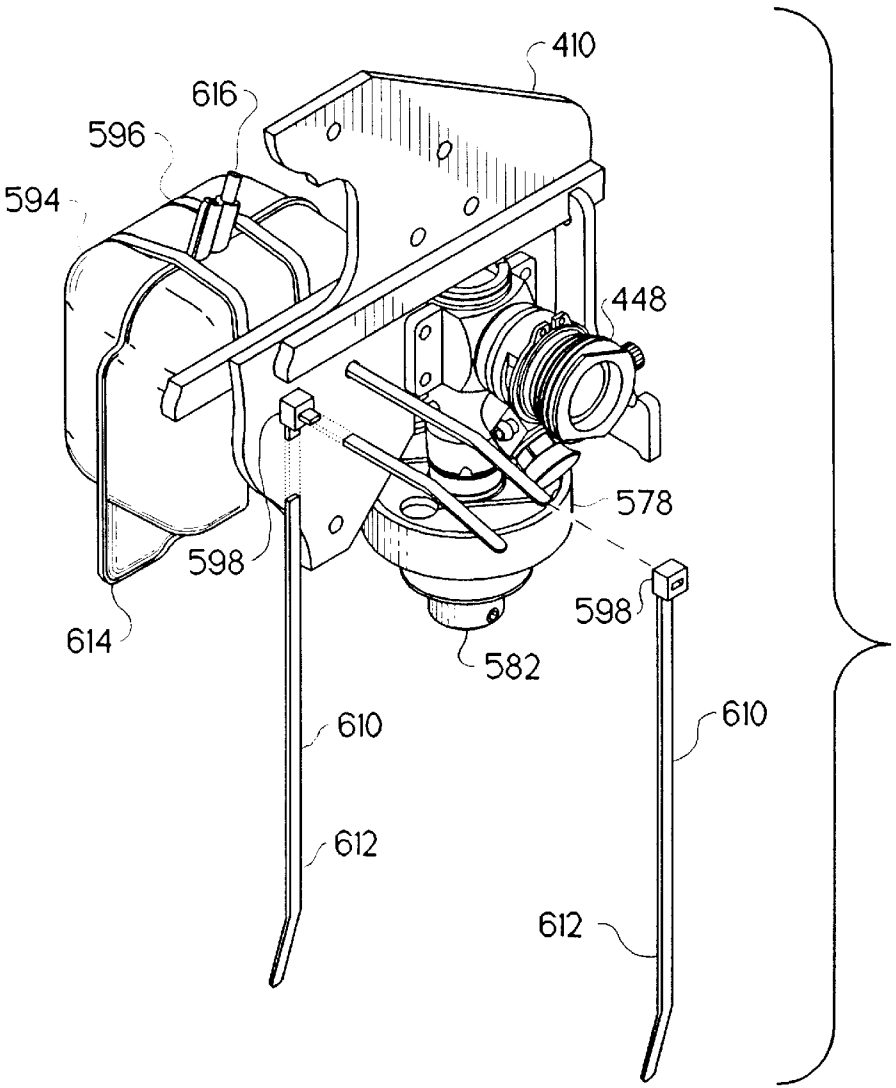
FIG. 20A is an enlarged perspective view of a rear section of the model helicopter of FIG. 1 showing installation of the engine and fuel tank on the keel, with the engine heat sink and all parts foward of the engine fuel tank removed for clarity.
Figure 21A:
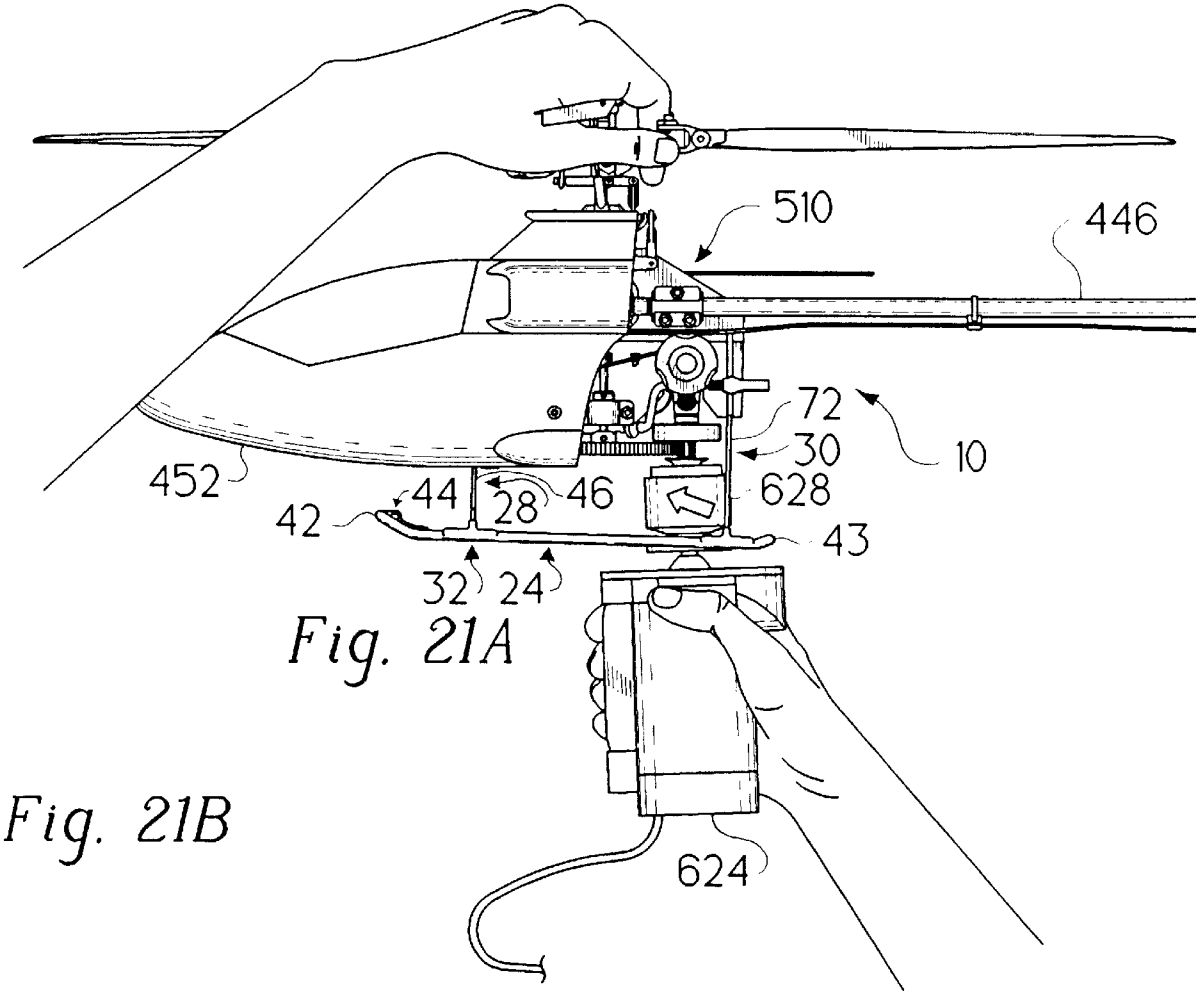
FIG. 21A is a side elevational view of the present invention showing application of an electric hand-held starting motor to an engine starter cone to start the model helicopter engine.
Figure 21B:
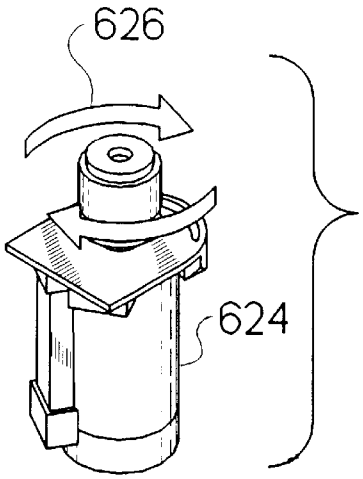
FIG. 21B is a perspective view of the electric hand-held starting motor.
Figure 22:
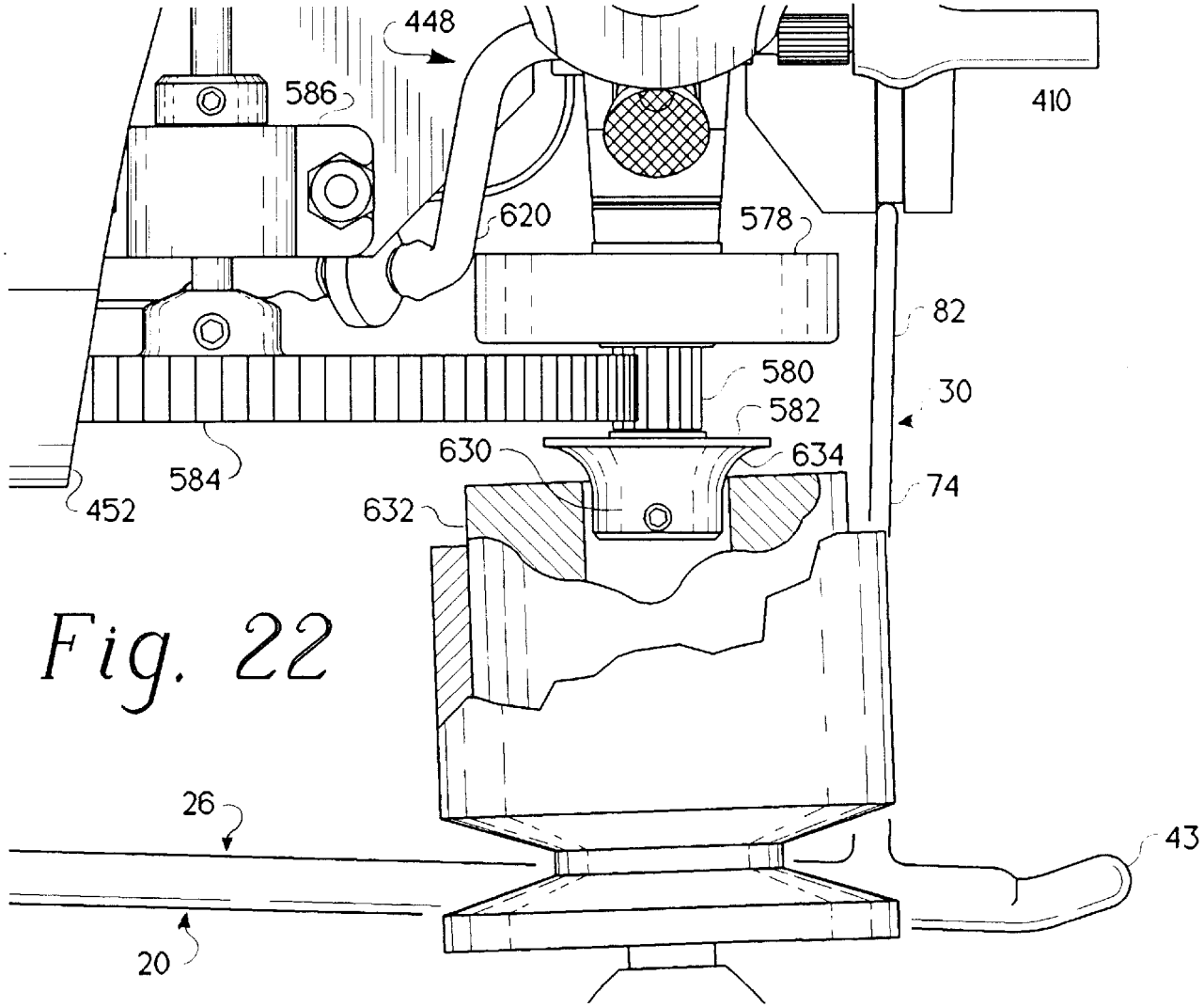
FIG. 22 is an enlarged side elevation view of a portion of the model helicopter shown in FIG. 21A, with starter motor elements shown in cut-away, and a landing gear strut and skid removed for clarity.
Figure 23A:
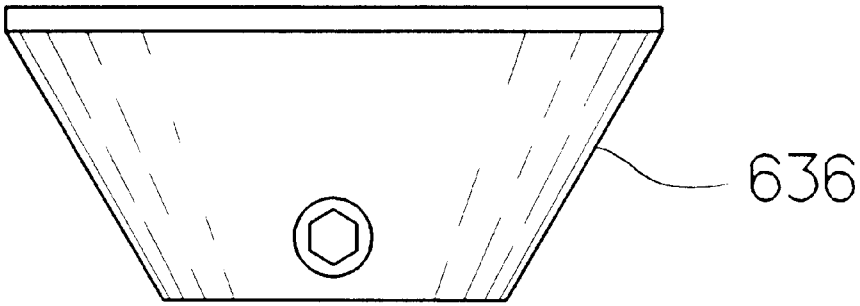
FIG. 23A is a side elevational view of a conventional starter cone.
Figure 23B:
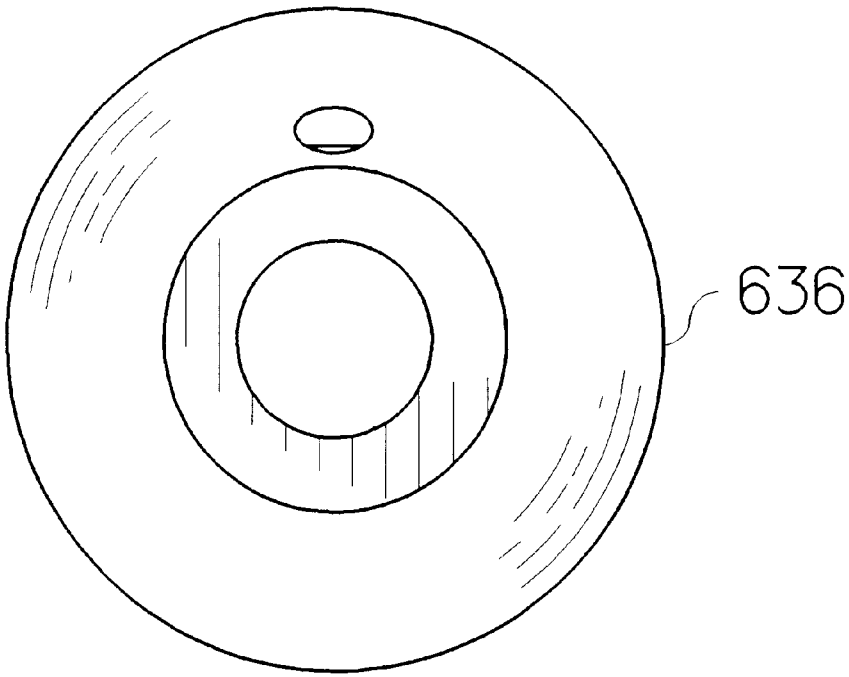
FIG. 23B is a top plan view of the conventional starter cone of FIG. 23A.

The four basic control functions required to fly a model helicopter 10 (fore-aft cyclic, right-left cyclic, tail rotor 16, and throttle/collective) each require a separate servo 472. Push-pull rods 478, 480, 482, 484 and bellcrank 486 connect servos 472 to main rotor 12, tail rotor 16 and engine 448. Fore-aft cyclic servo 488 and right-left cyclic servo 490 control main rotor 12 and cause helicopter 10 to tilt forward or backward, and right or left respectively as shown in FIGS. 17, 18. Tail rotor servo 492 rotates helicopter 10 about rotation axis 14 like a steering wheel on a car. Throttle/collective servo 494 controls the altitude and speed of helicopter 10 by adjusting the speed of engine 448 and/or the pitch of main rotor blades 436.

Fuselage 22 includes forward section or portion 496 supporting radio receiver 464 and servos 472, middle section or portion 498 having the canopy support frame, and rear section or portion 510 supporting engine 448. To better understand the fuselage structure of helicopter 10, it is easiest to look at individual pieces of fuselage 22 separated from the rest of helicopter 10 as shown in FIGS. 11A–11F. Floor 422 includes a forward end 512 facing toward the front section 496 of keel 410 and a rearward end 514 facing toward the rear section 510. Keel 410 is formed to include several apertures to reduce the weight of helicopter 10 and accommodate various mechanical and electronic system components. More specifically, keel 410 is formed to include weight-reduction holes 516, 518, 520; servo bays 522 and 524; gear-clearance hole 526; engine cutout 528; and multiple bolt and alignment holes 530.

Bulkhead reinforcement 420 shown in FIG. 11C is glued to and reinforces landing gear bulkhead 418 as shown in phantom in FIG. 11D. In preferred embodiments of the present invention, all structural elements of fuselage 22 shown in FIG. 11 are made of aircraft-grade plywood. Keel 410, landing gear bracket 412, and landing gear bulkhead 418 are approximately three times as thick as the remaining elements to carry higher structural loads. In alternative embodiments of the present invention, composite materials such as fiber-reinforced plastics could be substituted for plywood.

Figure 12:
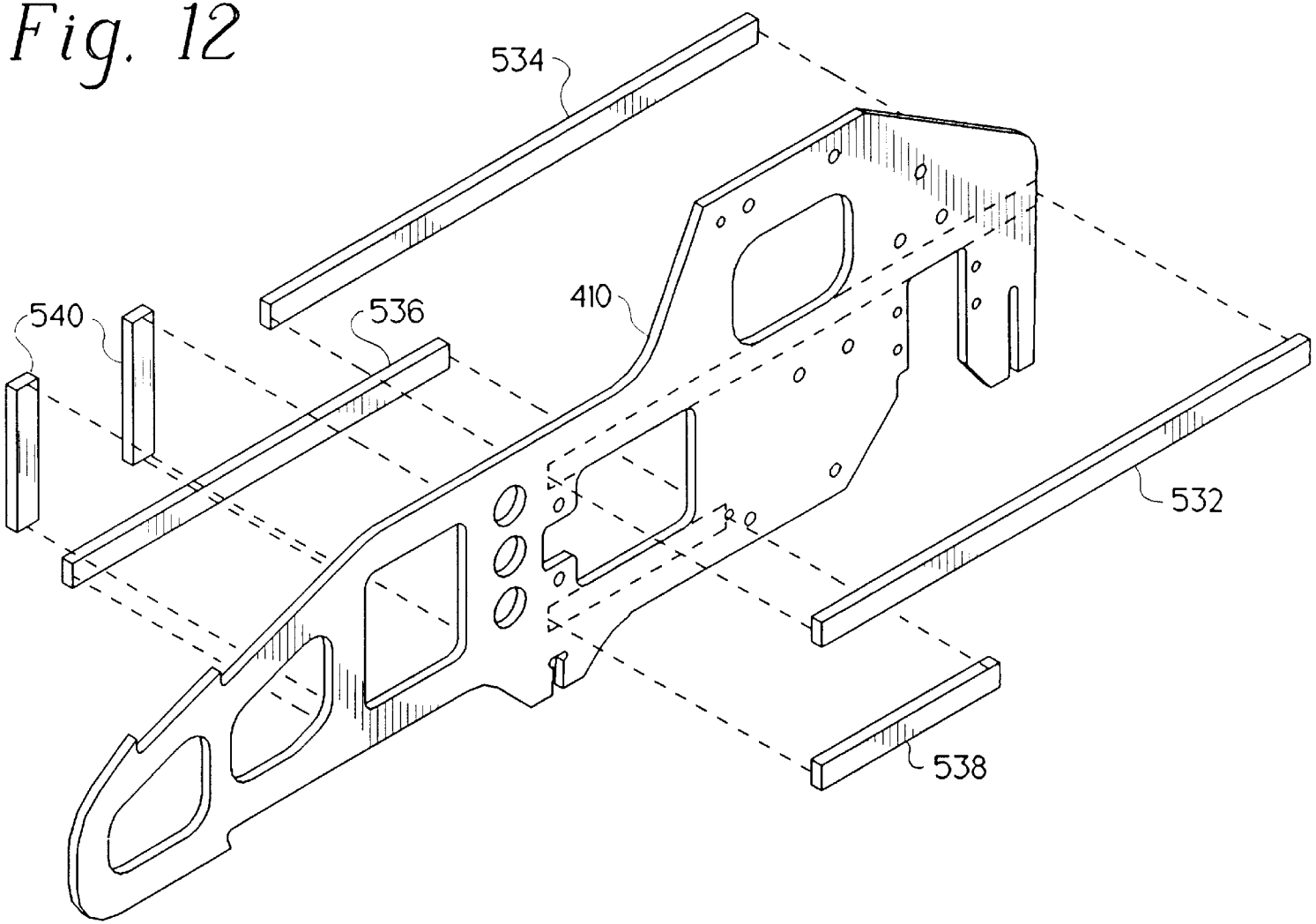
FIG. 12 is a perspective view of the elongated, flat keel showing the placement of stiffeners on the keel, with all other parts of the helicopter removed for clarity.

Fuselage 22 further includes keel stiffeners 532, 534, 536, and servo risers 538, 540 attached to keel 410 as shown in FIG. 12. Stiffeners 532, 534, 536 primarily stiffen keel 410 longitudinally, while servo risers 538, 540 provide raised mounting surfaces receptive to self-tapping screws used for mounting servos 472. In a preferred embodiment of the present invention, keel stiffeners 532, 534, 536 and servo risers 538, 540 are strips of spruce wood and are attached to keel 410 with glue.

Figure 13:
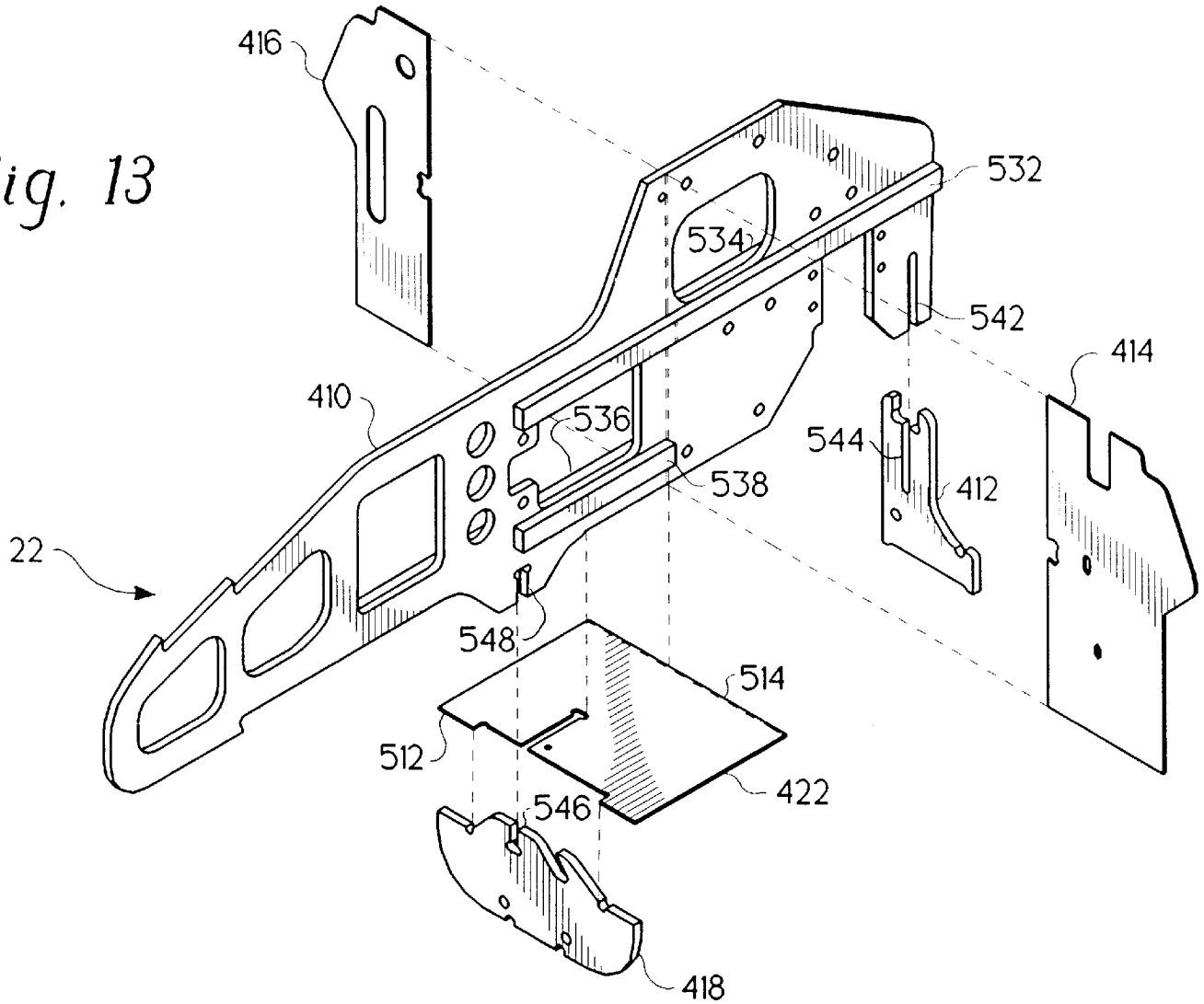
FIG. 13 is a view similar to FIG. 12 showing the orientation of the various fuselage structural elements shown in FIGS. 11B to 11F in relation to the keel and to each other.

The components of fuselage 22 are assembled as shown in FIG. 13. Landing gear bracket 412 is fixed (as by gluing) to keel 410 by inserting landing gear bracket 412 into alignment slot 542 formed in keel 410 until keel 410 extends completely into bracket slot 544 formed in landing gear bracket 412. In a similar fashion, landing gear bulkhead 418 is secured to keel 410 by connecting interlocking bracket slot 546 and alignment slot 548 formed in keel 410. Floor 422 is attached to landing gear bulkhead 418, keel 410, and fire wall halves 414 and 416 which are also affixed to keel 410. Floor 422 is situated perpendicular to keel 410.

After assembly, the structural elements shown in FIG. 13 are collectively referred to as fuselage 22. All mechanical and electronic systems of helicopter 10 are mounted to and almost completely obscure fuselage 22 as shown in FIG. 2. Alternate embodiments of the present invention are envisioned wherein the fuselage is made of plastic such as nylon or polycarbonate with bulkhead, fire walls, and/or floor elements molded integrally to the keel, or attached with adhesives or mechanical fasteners.

Figures 14, 14A:
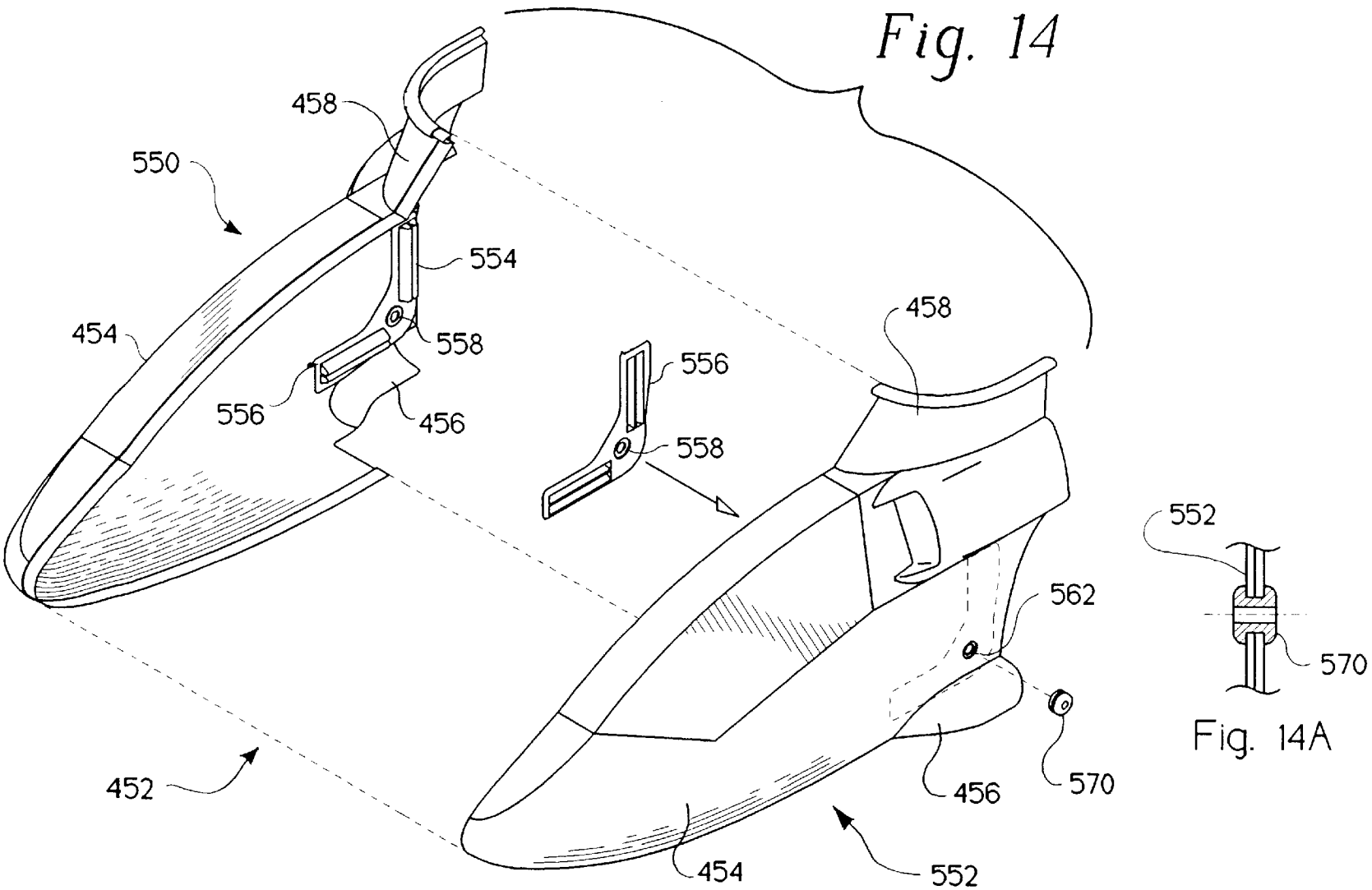
FIG. 14 is an exploded perspective view of the canopy of FIGS. 1 and 2 showing two canopy halves prior to assembly and showing the position of canopy mounting supports and mounting grommets.
FIG. 14A is a cross-sectional view of a mounting grommet installed in the canopy shown in FIGS. 1 and 14.
Figures 16, 16A:
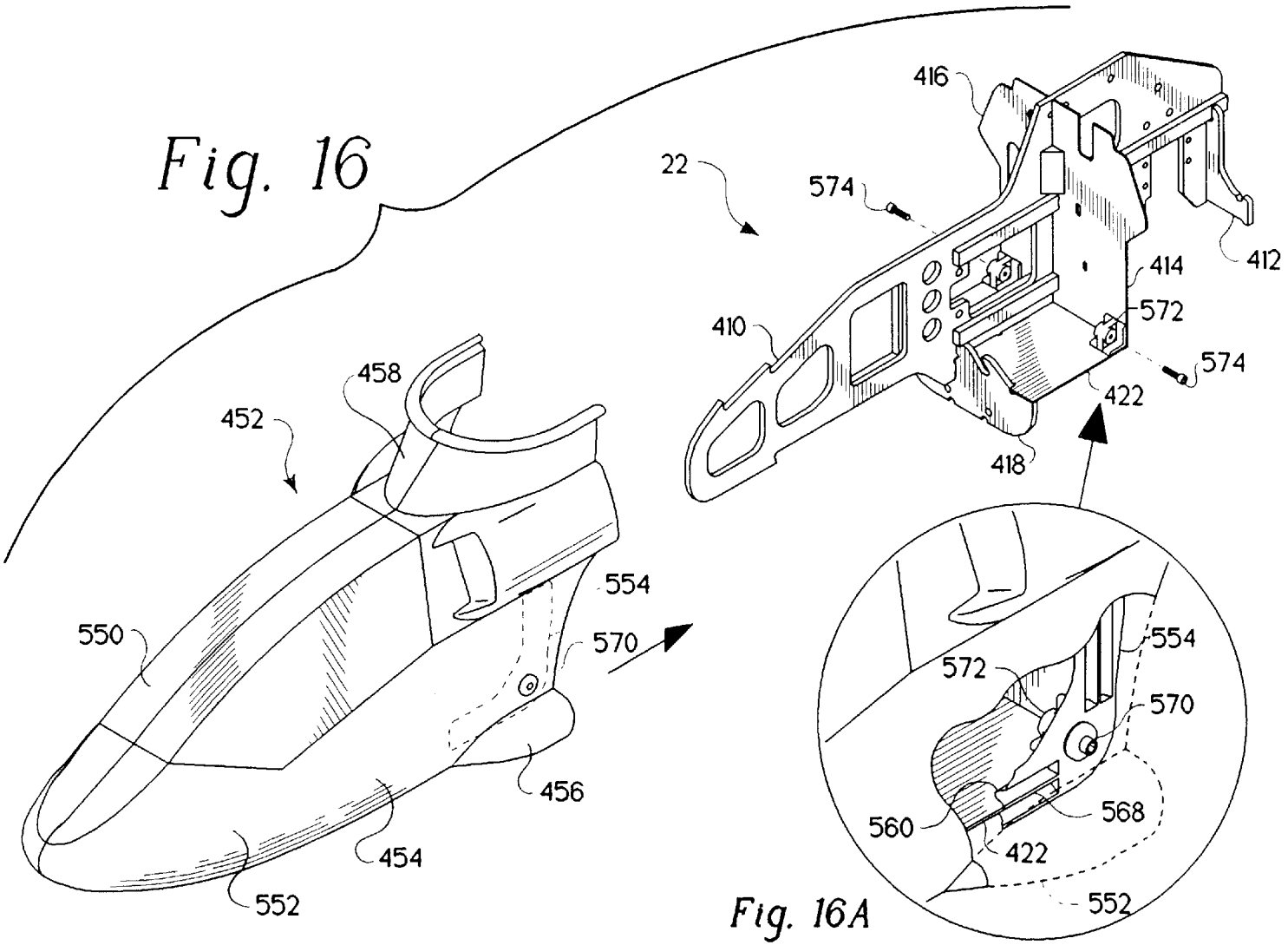
FIG. 16 is a perspective view showing attachment of the canopy to a keel carrying various fuselage structural elements, a portion of the fuselage structural elements which are assembled and mounted on the flat keel to act as a canopy support frame.
FIG. 16A is an enlarged perspective view of one part of the model helicopter of FIGS. 1, 2, and 16, with a portion of the canopy removed, showing the canopy attached to the canopy support frame.

The fire walls 414, 416, and floor 422 form a canopy support frame to which canopy 452 attaches as shown in FIGS. 16. Canopy 452 includes canopy halves 550, 552 as shown in FIG. 14. Canopy mounting supports 554, 556 are secured to the inside of each canopy half 550, 552 to reinforce canopy 452 and act as mounting and alignment brackets for canopy 452 when attached to the canopy support frame.

Figure 15A:
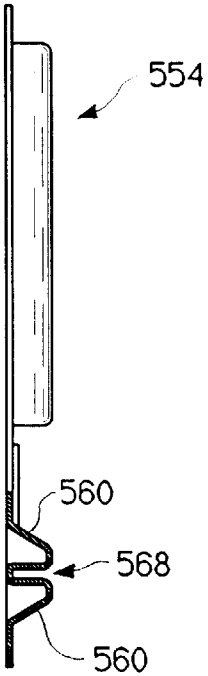
FIG. 15A is a sectional view taken along line 15A—15A of FIG. 15 showing a mounting groove that functions to attach the canopy mounting support to the model helicopter fuselage.
Figure 15:
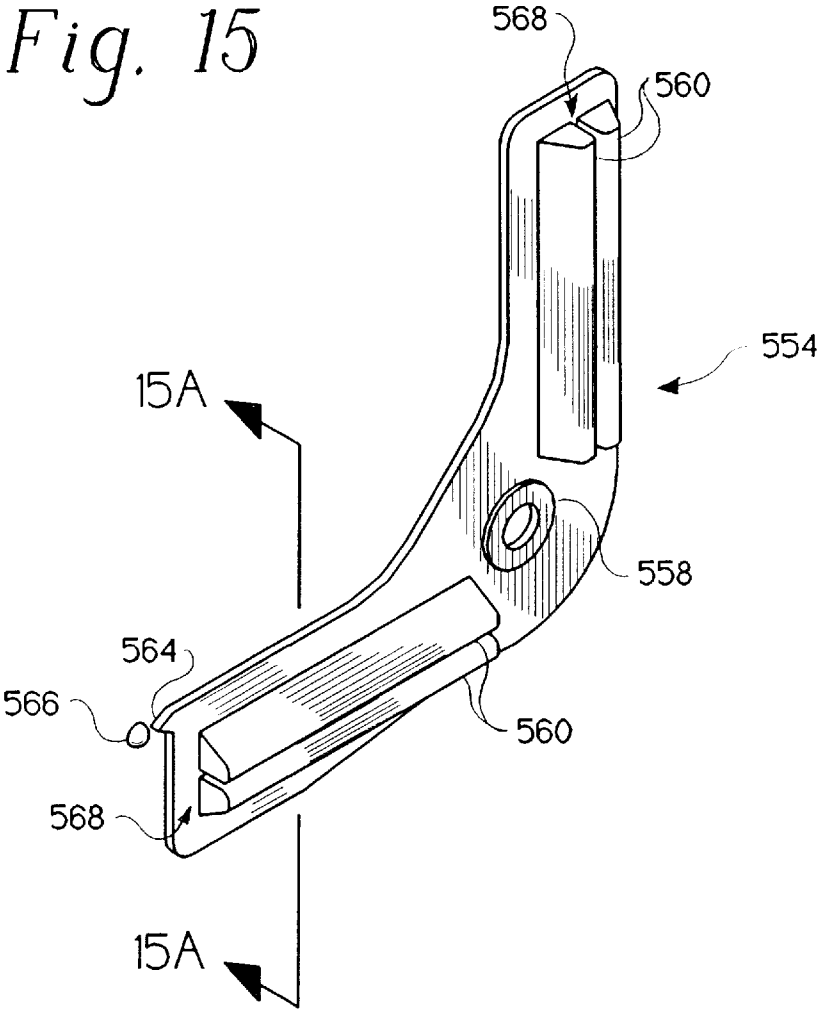
FIG. 15 is an enlarged perspective view of a canopy mounting support in accordance with the present invention.

Canopy mounting supports or doublers 554, 556 include alignment detent 558 and mounting ridges 560. Alignment detent 558 of canopy mounting support 554 engages a matching detent 562 formed in body 454 of canopy half 550. Alignment arrow 564 on mounting support 554 aligns with alignment mark 566 on the inside of canopy half 550 when mounting support 554 is properly aligned on the inside of canopy half 550 as shown in FIG. 15. Mounting ridges 560 form mounting grooves 568 receptive to floor 422 and fire wall halves 414, 416 of the canopy support frame. Mounting grommet 570 is installed in each of alignment detents 558 as shown in FIG. 14A. In preferred embodiments of the present invention, mounting supports 554 are formed of sheet plastic identical to that of canopy 452, and can be manufactured in one forming operation along with canopy 452.

Canopy attachment blocks 572 are attached to the canopy support frame as shown in FIGS. 16 and 16A. More specifically, canopy attachment blocks 572 are situated at the junction of fire wall halves 414, 416 and floor 422 to receive canopy attachment bolts 574 which secure canopy 452 to the canopy support frame as shown in FIGS. 1, 16, and 16A. Canopy 452 is slid over the front of fuselage 22 until mounting grommets 570 pass over the tops of attachment bolts 574. Grommets 570 are then pressed onto bolts 574 until the edges of floor 422 and fire wall halves 414, 416 seat firmly within mounting grooves 568 in mounting supports 554, 556.

Canopy 452 can be removed from canopy support frame by slowly pulling the rear of canopy 452 outward until grommets 570 slip off of attachment bolts 574, or by removing attachment bolts 574 from attachment blocks 572.

It is understood that landing gear bulkhead 418, floor 422, keel 410, and fire wall halves 414, 416 form a series of mutually supporting structural elements which greatly increase the strength and stiffness of fuselage 22. These structural elements also separate and protect forward section 496 of fuselage 22 inside canopy 452 from oily engine exhaust and airborne debris as shown in FIGS. 1 and 2. This is advantageous because radio receiver 464, battery 474, and servos 472 are housed in forward section 496.

The location of radio system 464 and engine drive train components on fuselage 22 is shown in FIGS. 17 and 18, with electric wiring between radio system 464 components removed for clarity. Servos 472 include tail rotor servo 492, throttle servo 494, fore-aft cyclic servo 488, and roll cyclic servo 490. All of servos 488, 490, 492, 494 are positioned in forward section 496 of fuselage 22.

The power train of helicopter 10 includes clutch assembly 578 having clutch pinion 580 and starter cone 582 mounted to engine 448 and driving main gear 584 secured to the lower end of main shaft 450. Main shaft 450 extends through ball bearings in lower ball-bearing block 586 and upper ball bearing block 588 and is operably connected at its upper end to main rotor 12. Ball-bearing blocks 586, 588 are secured to keel 410 in rear portion 510 of fuselage 22.

Main shaft 450 transfers rotation for the power train to main rotor 12 and tail rotor 16. Main rotor 12 is directly connected to main shaft 450 thereby rotating with main shaft 450. Rotation is transferred from main shaft 450 to tail rotor 16 by crown gear 590, tail rotor pinion gear 592, and a tail rotor drive shaft (not shown). Crown gear 590 is securely fastened to main shaft 450 and engages tail rotor pinion gear 592 which is affixed to the tail rotor drive shaft (not shown) inside tail tube 446. The drive shaft is connected to tail rotor 16 thereby transmitting rotational motion of main shaft 450 to tail rotor 16. In operation, excess oil from engine 448 drips into clutch assembly 578 thereby lubricating interior clutch elements including the interior of clutch pinion 580. In the illustrated embodiment, the engine is a COX TD 0.049/0.051. In other embodiments, the engine is a Norvel™ vmax-6™.

Although the invention has been described and defined in detail with reference to certain preferred embodiments, variations and modifications exist within the scope and spirit of the invention as described and defined in the following claims.

What is claimed is:

1. A landing gear assembly for use on a model helicopter having a body, the landing gear assembly comprising a landing gear strut having a leg portion and a foot portion connected to the leg portion to define an included right angle between the foot portion and the leg portion and a landing gear skid being formed to include a landing gear strut attachment area, the foot portion of the landing gear strut engaging the landing gear strut attachment area.

2. The landing gear assembly of claim 1, wherein the landing gear strut attachment area includes a trapping segment configured to receive and retain the foot portion of the landing gear strut.

3. The landing gear assembly of claim 2, wherein the landing gear strut attachment area further includes a boot in communication with the trapping segment and configured to receive and retain a portion of the leg portion of the landing gear strut.

4. The landing gear assembly of claim 3, wherein the landing gear skid includes a top surface adapted to face upwardly toward a body of a model helicopter and the boot extends upwardly away from the top surface of the landing gear skid and toward the body of the model helicopter.

5. The landing gear assembly of claim 3, wherein the leg portion of the landing gear strut is held within the upright boot by a snap fit connection and the foot portion of the landing gear strut is held within the trapping segment by a snap fit connection.

6. The landing gear assembly of claim 3, wherein the trapping segment is defined by a trapping channel formed in the landing gear skid and the upright boot includes a collar and a boot channel extending through the collar and communicating with the trapping channel, the trapping channel extends along a first axis and the boot channel extends along a second axis that is substantially perpendicular to the first axis to define a L-shaped slot in the landing gear skid.

7. The landing gear assembly of claim 1, further comprising a movable locking element arranged to move relative to the landing gear strut attachment area and the locking clement engages the landing gear strut attachment area and the landing gear strut to connect the landing gear strut to the landing gear skid.

8. The landing gear assembly of claim 1, wherein the leg portion of the landing gear strut is held in the landing gear strut attachment area by a snap-fit connection.

9. A landing gear assembly for use on a model helicopter having a body, the landing gear assembly comprising a landing gear strut having a leg portion and a foot portion connected to the leg portion to define an included angle between the foot portion and the leg portion and a landing gear skid being formed to include a landing gear strut attachment area, the foot portion of the landing gear strut engaging the landing gear strut attachment area, wherein the leg portion includes a lower section positioned to lie adjacent to the foot portion of the landing gear strut and an upper section spaced apart from the lower section and the landing gear strut attachment area includes a loading segment configured to receive the foot portion of the landing gear strut, a trapping segment configured to receive the foot portion from the loading segment and retain the foot portion within the landing gear skid, and an upright-connecting segment configured to receive and retain the lower section of the leg portion of the landing gear strut.

10. The landing gear assembly of claim 9, wherein the lower section of the leg portion of the landing gear strut is connected to the landing gear strut by a snap-fit connection in the upright-connecting segment.

11. The landing gear assembly of claim 9, wherein the loading segment is defined by a loading channel formed in the landing gear skid, the trapping segment is defined by a trapping channel formed in the landing gear skid, and the boot includes a collar and a boot channel extending through the collar, the loading channel and trapping channel extend along a first axis and the boot channel extends along a second axis that is substantially perpendicular to the first axis to define a T-shaped slot in the landing gear skid.

12. A landing gear assembly for use on a model helicopter having a body, the landing gear assembly comprising a landing gear strut having a leg portion and a foot portion connected to the leg portion to define an included angle between the foot portion and the leg portion and a landing gear skid being formed to include a landing gear strut attachment area, the foot portion of the landing gear strut engaging the landing gear strut attachment area, wherein the leg portion includes a lower section positioned to lie adjacent to the foot portion of the landing gear strut and an upper section spaced apart from the lower section, the foot portion and lower section of the leg portion of the landing gear strut form a L-shaped portion, and the landing gear strut attachment area is formed to include an L-shaped configured to receive the L-shaped portion of the landing gear strut.

13. A landing gear assembly for use on a model helicopter having a body, the landing gear assembly comprising a landing gear strut having a leg portion and a foot portion connected to the leg portion to define an included angle between the foot portion and the leg portion, a landing gear skid being formed to include a landing gear strut attachment area, the foot portion of the landing gear strut engaging the landing gear strut attachment area, and, a locking element engaging the landing gear strut attachment area and the landing gear strut to connect the landing gear strut to the landing sear skid, wherein the landing gear skid includes a top surface facing upwardly toward a body of the model helicopter and the landing gear strut attachment area includes a channel formed in the top surface of the landing gear skid, a boot adapted to extend upwardly from the top surface of the landing gear skid toward the body of the helicopter, and spaced-apart locking pin-receiving apertures formed in the landing gear skid adjacent to the boot, the boot includes a collar and a boot channel arranged to extend through the collar and be in communication with the channel formed in the top surface of the landing gear skid to define an L-shaped slot formed in the landing gear skid, and the locking element includes a locking pin extending through the locking pin-receiving apertures and across the L-shaped slot to connect the landing gear strut to the landing gear skid.

14. A landing gear assembly for use on a model helicopter having a body, the landing gear assembly comprising a landing gear strut having a leg portion and a foot portion connected to the leg portion to define an included angle between the foot portion and the leg portion, a landing gear skid being formed to include a landing gear strut attachment area, the foot portion of the landing gear strut engaging the landing gear strut attachment area, and a locking element engaging the landing gear strut attachment area and the landing gear strut connecting the landing gear strut to connect the landing gear skid, wherein the landing gear strut attachment area includes an L-shaped slot formed in the landing gear skid and locking pin-receiving apertures formed in the landing gear skid adjacent to the L-shaped slot, the foot portion of the landing gear strut is situated in the L-shaped slot, and the locking element includes a locking pin extending through the locking pin-receiving apertures and across the L-shaped slot to trap the foot portion of the landing gear strut in the landing gear skid.

15. A landing gear assembly for use on a model helicopter having a body, the landing gear assembly comprising a landing gear strut having a leg portion and a foot portion connected to the leg portion to define an included angle between the foot portion and the leg portion a landing gear skid being formed to include a landing gear strut attachment area, the foot portion of the landing gear strut engaging the landing gear strut attachment area, and a locking element engaging the landing gear strut attachment area and the landing gear strut to connect the landing gear strut to the landing sear skid, wherein the locking element is a cable tie.

16. A landing gear assembly for use on a model helicopter having a body, the landing gear assembly comprising a landing gear skid and a landing gear strut having a first end adapted to attach to a body of a model helicopter and a second end connected to the landing gear skid in a snap-fit connection.

17. The landing gear assembly of claim 16, wherein the landing gear strut includes a leg portion and a foot portion connected to the leg portion and the landing gear skid is formed to include a L-shaped slot configured to receive the foot portion of the landing gear strut.

18. The landing gear assembly of claim 17, wherein the leg portion of the landing gear strut includes a lower section appended to the foot portion to define an included angle between lower section of leg section and foot portion so that the lower section of the leg portion and the foot portion form a L-shaped portion of the landing gear strut.

19. The landing gear assembly of claim 18, wherein the L-shaped portion of the landing gear strut is situated within the L-shaped slot formed in the landing gear skid and the foot portion and lower section of leg portion are both attached to the L-shaped slot in a snap-fit connection.

20. The landing gear assembly of claim 18, wherein the L-shaped portion of the landing gear strut is situated within the L-shaped slot formed in the landing gear skid and the lower section of leg portion is attached to the L-shaped slot in a snap-fit connection.

21. The landing gear assembly of claim 17, wherein the L-shaped slot includes a first channel configured to receive and retain the foot portion and a second channel in communication with the first channel and extending substantially perpendicular to the first channel.

22. The landing gear assembly of claim 17, wherein the leg portion of the landing gear strut includes a lower section appended to the foot portion to define an included angle between lower section of leg portion and foot portion so that the lower section of the leg portion and the foot portion form a L-shaped portion of the landing gear strut.

23. The landing gear assembly of claim 22, wherein the L-shaped portion of the landing gear strut is situated within the L-shaped slot formed in the landing gear skid and the foot portion is attached to the first channel in a snap-fit connection and lower section of leg portion is attached to the second channel in a snap-fit connection.

24. The landing gear assembly of claim 22, wherein the L-shaped portion of the landing gear strut is situated within the L-shaped slot formed in the landing gear skid and the lower section of leg portion is attached to the second channel in a snap-fit connection.

25. The landing gear assembly of claim 16, wherein the landing gear strut includes a leg portion and a foot portion connected to the leg portion and the landing gear skid is formed to include a first channel configured to receive the foot portion, a second channel configured to trap the foot portion, and a third channel configured to trap the leg portion.

26. The landing gear assembly of claim 25, wherein the first, second, and third channels define an inverted T-shaped slot.

27. The landing gear assembly of claim 25, wherein the first channel and second channel are substantially coaxial and the third channel is substantially perpendicular to the first and second channels.

28. A landing gear assembly for use on a model helicopter, the landing gear assembly comprising a landing gear strut including a leg portion having a diameter and a foot portion appended to the leg portion to define an included right angle between the leg portion and the foot portion and the foot portion having a length that is greater than the diameter of the leg portion and a landing gear skid being formed to include a landing gear strut attachment area configured to receive the foot portion of the landing gear strut.

29. A landing gear strut for use on a landing gear assembly of a model helicopter having a body, the landing gear strut comprising a body-connecting portion adapted to connect to a body of a model helicopter, a foot portion spaced apart from the body-connecting portion, and a leg portion extending between the body-connecting portion and the foot portion, the foot portion being connected to the leg portion to define an included right angle between the foot portion and leg portion.

30. A landing gear assembly of a model helicopter, the landing gear assembly comprising a landing gear strut and a landing gear skid being formed to include a L-shaped slot sized to receive the landing gear strut.

31. A landing gear assembly for use on a model helicopter, the helicopter including a fuselage having a landing gear support, the landing gear assembly comprising at least one landing gear strut linked to the landing gear support, the at least one landing gear strut having a leg portion extending downward away from the fuselage to an angled foot portion, and a landing gear skid attached to the angled foot portion of the at least one landing gear strut, each landing gear skid being formed to include at least one slot receptive to the angled foot portion.

32. The landing gear assembly of claim 31, wherein the landing gear skid is formed to include a hollow area configured to receive an angled foot portion and the angled foot portion of the at least one landing gear strut engages the hollow area.

33. The landing gear assembly of claim 32, wherein the landing gear skid further includes at least one boot, the slot is L-shaped and extends through the at least one boot, and the leg portion engages the portion of the L-shaped slot extending through the boot when the angled foot portion is engaged in the hollow area.

34. The landing gear assembly of claim 31, further comprising a second landing gear strut spaced apart from the first landing gear strut.

35. A landing gear assembly for use on a model aircraft, the landing gear assembly comprising a skid and a landing gear strut connecting the skid to the model aircraft, the landing gear strut having a leg portion and a foot portion extending at an included right angle to the leg portion, said skid being receptive to the leg portion and the foot portion of the landing gear strut to connect the skid to the landing gear strut.

36. A landing gear assembly for use on a model aircraft, the landing gear assembly comprising a skid and a landing gear strut connecting the skid to the model aircraft, the landing gear strut having a leg portion and a foot portion extending at an included angle to the leg portion, said skid being receptive to the leg portion and the foot portion of the landing gear strut to connect the skid to the landing gear strut, wherein the skid is engageable with one of the leg portion and foot portion of the landing gear strut in a snap-fit connection and the snap-fit connection is expandable to facilitate entry of the one of the leg portion and foot portion of the landing gear Strut into the snap-fit connection and closeable about the one of the leg portion and foot portion of the landing gear strut.

37. The landing gear assembly of claim 36, wherein the skid includes a hollow area receptive to the foot portion of the landing gear strut and a boot portion engageable in a snap-fit connection with the leg portion of the landing gear strut.

38. The landing gear assembly of claim 35, further comprising locking means for maintaining communication of the skid and landing gear strut.

39. The landing gear assembly of claim 38, wherein the skid includes a boot portion engageable with the leg portion of the landing gear strut, the skid is receptive to the foot portion of the landing gear strut, and the locking means is a cable tie surrounding the boot portion of the skid and retaining the leg portion of the landing gear strut within the boot portion of the skid.

40. A landing gear assembly for use on a model aircraft, the landing gear assembly comprising a skid and a landing gear strut connecting the skid to the model aircraft, the landing gear strut being connected to the skid with a snap-fit connection.

41. A landing gear assembly for use on a model aircraft, the landing gear assembly comprising a skid and a landing gear strut connecting the skid to the model aircraft, the landing gear strut having a leg portion and a foot portion extending at an included right angle to the leg portion, said skid having a hollow area receptive to the foot portion of the landing gear strut, and means to retain the foot portion of the landing gear strut within the hollow area of the skid.

42. A model helicopter comprising a fuselage having a landing gear mounting, a landing gear skid located in spaced-apart relation to the fuselage, a landing gear strut connecting the landing gear mounting to the fuselage, and means for attaching the landing gear mounting to the fuselage, the attaching means comprising a cable tie wherein the landing gear strut abuts the fuselage at the landing gear mounting and the cable tie secures the landing gear strut to the fuselage.

43. A method for assembling a landing gear skid to a landing gear strut of a model helicopter, the method comprising the steps of providing a landing gear strut and a landing gear skid being formed to include a landing gear strut attachment area and snapping the landing gear strut into the landing gear strut attachment area.

44. The method of claim 43, wherein the landing gear strut includes a leg portion and a foot portion appended to the leg portion to define an included angle between the leg portion and foot portion and further comprising the step of snapping the leg portion into the landing gear strut attachment area.

45. The method of claim 44, wherein the landing gear strut attachment area includes a loading segment, a trapping segment, and an upright-connecting segment and the leg portion includes a lower section positioned to lie adjacent to the foot portion and an upper section spaced apart from the lower section and further comprising the steps of inserting the foot portion of the landing gear strut into the loading segment, sliding the foot portion from the loading segment into the trapping segment, and rotating the landing gear skid about the foot portion to place the lower section of the leg portion within the upright-connecting segment.

46. The method of claim 45, further comprising the step of snapping the lower section of the leg portion into the upright-connecting segment.

47. The method of claim 44, wherein the landing gear strut attachment area includes a L-shaped slot having a loading/trapping segment and an upright-connecting segment and the leg portion includes a lower section positioned to lie adjacent to the foot portion of the landing gear strut and an upper section spaced apart from the lower section and further comprising the steps of snapping the foot portion of the landing gear strut into the loading/trapping segment and snapping the lower section of the leg portion of the landing gear strut into the upright-connecting portion.

48. A method for assembling a landing gear skid to a landing gear strut of a model helicopter, the method comprising the steps of providing a landing gear strut and a landing gear skid being formed to include a landing gear strut attachment area, inserting the landing gear strut into the landing gear strut attachment area, wherein the landing gear strut includes a leg portion and a foot portion appended to the leg portion to define an included angle between the leg portion and foot portion, and snapping the leg portion into the landing gear strut attachment area.

* * * * *